United States Patent [19]

Hotomi et al.

[11] Patent Number: 4,939,056

[45] Date of Patent: Jul. 3, 1990

[54] PHOTOSENSITIVE MEMBER

[75] Inventors: Hideo Hotomi; Izumi Osawa; Kenji Masaki; Hideaki Ueda, all of Osaka, Japan

[73] Assignee: Minolta Camera Kabushiki Kaisha, Osaka, Japan

[21] Appl. No.: 255,839

[22] Filed: Sep. 23, 1988

[30] Foreign Application Priority Data

| | | | |
|---|---|---|---|
| Sep. 25, 1987 | [JP] | Japan | 62-242340 |
| Nov. 18, 1987 | [JP] | Japan | 62-294477 |
| Jun. 24, 1988 | [JP] | Japan | 63-157647 |

[51] Int. Cl.[5] ..... G03G 5/14

[52] U.S. Cl. ..... 430/66; 430/58; 430/67; 430/59

[58] Field of Search ..... 430/66, 67, 58

[56] References Cited

U.S. PATENT DOCUMENTS

| | | | |
|---|---|---|---|
| 4,365,013 | 12/1982 | Ishioka et al. . | |
| 4,544,617 | 10/1985 | Mort et al. . | |
| 4,755,426 | 7/1988 | Kokai et al. | 428/408 X |
| 4,755,444 | 7/1988 | Karakida et al. | 430/66 |
| 4,770,966 | 9/1988 | Kazama et al. | 430/66 |

FOREIGN PATENT DOCUMENTS

| | | | |
|---|---|---|---|
| 56-62254 | 5/1981 | Japan . | |
| 59-223443 | 12/1984 | Japan | 430/66 |
| 60-61761 | 4/1985 | Japan . | |
| 60-249155 | 12/1985 | Japan . | |
| 1174171 | 12/1989 | United Kingdom . | |

OTHER PUBLICATIONS

*A Review of Recent Advances in Plasma Polymerization,* by Shen and Bell, Department of Chemical Engineering, U. of California, Berkley, Calif. 94720.

"Properties of Diamond-Like Carbon Films", *Thin Solid Films,* vol. 119, pp. 121–126, 1984.

"Electronic Properties of Substitutionally Doped Amouphous Si and Ge", *Philisophical Magazine,* vol. 33, No. 6, pp. 935–949, 1976.

"Photosensitive Materials for Electron Photography—OPC vs. Inorganics", *Nikkei New Materials,* Dec. 15, 1986.

*Primary Examiner*—Paul R. Michl

*Assistant Examiner*—Jeffrey A. Lindeman

*Attorney, Agent, or Firm*—Burns, Doane, Swecker & Mathis

[57] ABSTRACT

This invention provides a photosensitive member with a surface protector layer. The surface protective layer comprises a resin layer and an amorphous carbon layer. The surface protective layer of the invention is effective for a soft photoconductive layer, for example, an inorganic photoconductive layer such as a selenium layer, a selenium-arsenic, selenium-tellurium layer, and an organic photoconductive layer. The surface protective layer does not deteriorate the photosensitive properties. The photosensitive layer of the invention is excellent in durability and resistance to peeling off.

30 Claims, 3 Drawing Sheets

PHOTOSENSITIVE MEMBER

BACKGROUND OF THE INVENTION

This invention relates to a photosensitive member with a surface protective layer.

An amorphous selenium photosensitive member is well known as an electrophotographic photosensitive member, and its defects such as heat resistance, spectrosensitivity and dark decay are improved by adding arsenic into the selenium layer or forming a layer of selenium-tellurium alloy on the selenium layer.

A photosensitive member made of a selenium-arsenic alloy is more sensitive in relative luminous efficiency, which is needed by a conventional copying machine, than any other photosensitive member, and a photosensitive member having a selenium-tellurium alloy layer on a selenium layer is one of the most sensitive members in the region of long wavelength, which is needed by a printer having a laser light source.

But, the above mentioned photosensitive members have problems such as image defects and white lines, because a selenium-arsenic alloy or selenium-tellurium alloy has the softness of about H in the pencil hardness of JIS-K5400 specification. Therefore the surface of photosensitive members are shaved or damaged by the repeated friction against a sheet of copying paper, a cleaning member and a developer etc.

One reason for the shave or the damage is that when jammed paper is removed, the surface of a photosensitive member is contacted severely against the paper.

Besides, as selenium and arsenic are poisonous, shaved selenium or arsenic or vaporized selenium or arsenic caused by the heat inside a copying machine may be harmful to humans.

On the other hand, photosensitive member with organic photoconductive materials incorporated in binder resin is well known, and has the advantages of no sanitary problem and a good industrial productivity in comparison with a photosensitive member constituted of, for example, selenium and cadmium sulfide.

But an organic photosensitive member lacks hardness and is liable to be shaved or damaged by the friction with a sheet of copying paper, a cleaning member, a developer and so on when used repeatedly.

It is proposed to overcome the above mentioned problems by forming a protective layer on the surface of a photosensitive member. It is, although, basically important to a surface protective layer that the formation of surface protective layer does not lower the properties of a photosensitive member and the surface protective layer is not peeled off when used.

Japanese Patent KOKAI No. 61761/1985 discloses a photosensitive member having a diamond-like carbon layer on a photoconductive layer.

The above mentioned photosensitive member has such defects that the stability of surface voltage is poor and the density of images are liable to decrease. The above KOKAI journal also discloses that amorphous silicon is used as a photoconductive layer. The application of the diamond like carbon layer to a surface protective layer on a selenium photosensitive member, although, may provide such problems as the deterioration of chargeability and adhesivity.

Japanese Patent KOKAI Nos. 23636/1978 and 111734/1978 disclose an photosensitive member with a insulation layer formed by dispersing and curing of a specific silicon compound on a photoconductive layer of the selenium series.

The low surface hardness of the above mentioned photosensitive member provides such defects that the surface of the photosensitive member is liable to be injured.

Japanese Patent KOKAI No. 58437/1984 discloses a photosensitive member with a protective layer made mainly from Si and N-containing compounds or Si and O-containing compounds on a photoconductive layer constituted by selenium. The photosensitive member above mentioned, although, has such defects that the humidity resistance is poor and the image is liable to flow.

A plasma polymerized layer of a proper organic compound is proposed as one kind of surface protective layer (for example, Japanese Patent KOKAI No. 32055/1985). If a plasma polymerization is carried out over the surface of a organic photoconductive layer, charge generating materials or charge transporting materials etc. in a photosensitive layer are rather deteriorated by plasma, and that the properties of a photosensitive member becomes poor.

The plasma polymerization destroys the surface structure of an organic photoconductive layer under the impact of electrons or ions. If there is a charge transporting layer at the surface side of the photoconductive layer, the transportability near the surface of the charge transporting layer decreases and the residual potential increases. If there is a charge generating layer at the surface side of the photoconductive layer, the charge generating ability decreases to show almost no photosensitivity. If a photoconductive layer is a monolayer type containing a generating material and a charge transporting material, both the charge transporting ability and the charge generating ability are deteriorated at the same time.

On the other hand, organic plasma-polymerized layers formed inorganic photoconductive layers such as selenium, selenium-tellurium alloy, selenium-arsenic alloy and so on, is so poor in adhesivity between those layers that the plasma-polymerized layers are liable to peel off from the inorganic photoconductive layers.

SUMMARY OF THE INVENTION

The objects of the invention are to provide a photosensitive member excellent enough to show satisfactory properties in, for example, not only photosensitive properties but also durability, even if the photoconductive layer is one such as a monolayer type of selenium-arsenic alloy, or a laminated type constituted by selenium-tellurium alloy layer on selenium layer or an organic type having an organic photoconductive layer, the surface of which is soft and injured easily.

The objects of the invention can be achieved by forming protective layers on those photoconductive layers, The protective layer has two layers, one of which is a resin layer on a photoconductive layer and the other one of which is a plasma-polymerized amorphous carbon layer on the resin layer.

DETAILED DESCRIPTION OF THE INVENTION

Figure 1:
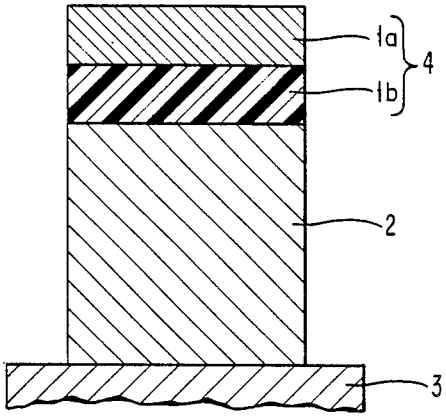
FIG. 1 illustrates a photosensitive member embodying in schematic cross sectioned representation.
Figure 5:
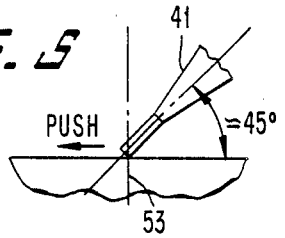

The invention is intended to provide a photosensitive member with a surface protective layer which comprises two layers, one of which is a resin layer on a photoconductive layer and the other one of which is an amorphous carbon layer (a-C layer) formed by a glow-discharge plasma polymerization method on the resin layer.

A surface protective layer of the invention is effective for a photosensitive member wherein its surface is soft and easily injured. The surface protective layer is excellent in peeling-off resistance and durability.

The formation of the surface protective layer does not impair the photosensitive properties, in particular, sensitivity and residual potential.

Examples of a photosensitive member, the surface of which is soft and injured easily, is one such as a monolayer type of selenium-arsenic alloy, a laminated type constituted of selenium-tellurium alloy layer on selenium layer, and an organic type constituted of an organic photoconductive layer.

When a surface protective layer is applied to an organic photoconductive layer, the photoconductive layer may be one of a monolayer type wherein both photoconductive materials and charge transporting materials are dispersed in binder resin, or one of a function divided type wherein a charge generating layer on a charge transporting layer are formed over an electrically conductive substrate. A charge transporting layer may be formed on a charge generating layer.

A photosensitive member with a photoconductive layer above mentioned is well known (for example, in NIKKEI NEW MATERIALS, page 83–page 98, issued at December, 14(1986)), and excellent in sensitivity, chargeability, productive cost performance and already put to practical use.

Illustrative examples of photoconductive materials which serve charge generation in an organic photoconductive layer are phthalocyanine pigments, azo pigments, perylene pigments, etc. Illustrative examples of photoconductive materials which serve charge transporting in an organic photoconductive layer are triphenyl methane compounds, triphenyl amine compounds, hydrazone compounds, styryl compounds, pyrazoline compounds, oxazole compounds, oxadiazole compounds. Examples of binder resin dispersing the charge generating materials and the charge transporting materials are polyester, polyvinyl butyral, polycarbonate, polyarylate, styrene-acrylic resin etc.

An electrically conductive substrate (3) is not restrictive, so long as its surface is electroconductive. The shape of the substrate may be a cylindrical type, a flexible belt type, or a plate type, etc.

A resin layer (1*b*) functions to protect a photoconductive layer from the plasma degradation of photosensitive properties such as residual potential, sensitivity and so on at the formation of an outermost surface layer (1*a*) by a plasma-polymerization, and it functions to improve the adhesivity between a photoconductive layer and an outer-most surface layer.

A resin layer may contain metal compounds with low electrical resistance.

Suitable resin applied to a resin layer is exemplified by thermosetting resins thermosetting resins or light-curable resins etc., in more detail thermoplastic binders such as polyester resin, polyamide resin, polybutadiene, acrylic resin, ethylene-vinyl acetate copolymer, ion-crosslinked olefin copolymer (ionomer), styrene-butadiene block copolymer, polycarbonate, vinyl chloride-vinyl acetate copolymer, cellulose ester and polyimide; thermosetting binders such as epoxy resin, urethane resin, silicone resin, phenolic resin, melamine resin, xylene resin, alkyd resin and thermosetting acrylic resin; photoconductive resins such as poly-N-vinylcarbazole, polyvinylpyrene and polyvinylanthracene; silicon resin may be used. These resins are usable singly or in admixture. preferable resins among the foregoing examples are acrylic resin, melamine resin, polycarbonate, polybutadiene, epoxy resin, silicon resin etc.

A resin layer (1*b*) is formed by applying a solution containing an above mentioned resin in an adequate solvent to a photoconductive layer (2) so that the thickness of the resin layer (1*b*) may be about 0.05–2 μm, preferably 0.1–1 μm after dried. If the thickness is thinner than 0.05 μm, an organic photoconductive layer is not protected effectively from plasma damage and it is poor in adhesivity between the selenium photoconductive layer and the outermost surface layer. If the thickness is thicker than 5 μm, the increase of residual potential can't be ignored and that the decrease of translucence bring about such a trouble as the decrease of sensitivity. An applying method, a spray method, a dipping method, a bar-coater method and so on, which are known, may be used. Further, a resin layer may be formed by a vapor-depositing method or a sputtering method.

When metal compounds with low electrical resistance are added to a resin layer, it is preferable that the resin layer is formed so that the electrical resistance of the layer may be preferably $10^9$–$10^{14}\Omega$·cm, and that light may not be prevented from passing through the layer.

As the electrical resistance of the resin layer can be regulated by adding the metal compounds, the resin layer can be formed thick to prevent plasma damage of the organic photoconductive layer and to give adhesivity between the selenium photoconductive layer and the outermost surface layer.

Preferable metal compounds are gray or white-blue fine particles and an have electrical resistance of $10^9\Omega$cm or less and particle size of 0.3 μm or less, preferable 0.1 μm or less. Embodiments of metal compounds are exemplified by indium oxide, tin oxide, titanium oxide, antimony oxide, solid solution of tin oxide and antimony solid, solution of tin oxide and antimony oxide, magnesium fluoride, silicon carbide and a mixture thereof. Tin oxide or magnesium fluoride is particularly preferred because they can decrease effectively the electrical resistance of a resin layer (1*b*).

A resin layer (1*b*) with dispersed metal compounds of low electrical resistance may be formed, for example, by applying a solution containing fine particles of the metal compounds and a resin for binder in an adequate solvent onto the surface of a photoconductive layer (2) so that the resin layer after drying may be from 0.05–5 μm, preferably 0.05–3 μm, more preferably 0.5–2 μm.

A resin layer with dispersed metal compounds of low electrical resistance need a thickness of at least 0.05 μm in order to protect the organic layer from plasma damages and to give the adhesivity between the selenium photoconductive layer and the outermost surface layer. If the thickness is thicker than 5 μm, the increase of residual potential can't be ignored and that the decrease of translucence brings about such trouble as the decrease of sensitivity.

A solvent for a dispersion solution for the formation of a resin layer can be chosen according to a selected resin and preferable solvent is one which can be dried easily and exemplified by aliphatic hydrocarbons such as gasoline, petroleum, benzine, mineral sprit, petroleum naphtha, V.M. & P. naphtha decalin tetralin, p-cymene and hexane; aromatic hydrocarbon such as benzene, toluene and xylene; halogenated hydrocarbons such as trichloroethylene, perchloroetylene, chloroform, tetrachloromethane, trichloroethylene, monochlorobenzene, monobromobenzene and dichlorobenzene; Alcohols such as amyl alcohol, ethyl alcohol, isopropyl alcohol, 2-ethyl-butyl alcohol, 2-ethyl-hexyl alcohol, cyclohexanol, methyl alcohol, methyl-amyl alcohol, benzyl alcohol, butyl alcohol; ketones such as acetone, acetonyl acetone, diisobutyl ketone, diethyl ketone, methyl amyl ketone, methyl butyl ketone, methyl cyclohexanone, dipropyl ketone, methyl ethyl ketone, methyl n-hexyl ketone, methyl isobutyl ketone, methyl propyl ketone mesityl oxide; esters such as acetates, butyrates, propionates and formates; alcohol esters such as butyl lactate, isopropyl lactate, ethyl lactate, ethyl oxypropionate diethyl maleate, ethyl acetoacetate, ethyl pyruvate; Ester such as isopropyl ester, ethyl ester, diethyl carbitol, diethyl Cellosolve and butyl ester; ketone alcohols such as acetonyl methanol, diacetone alcohol, dihydroxyl acetone and pyruvin alcohol; ether alcohols such as isopropyl Cellosolve, carbitol, glycidol, Cellosolve, glycol ether, benzyl Cellosolve, butyl carbitol, butyl Cellosolve, methyl carbitol, methyl Cellosolve, triethylenglycol monoethyl ether; ketone ethers such as acetal ethyl ether, acetonylmethanol ethyl ether, methylethoxy and ethyl ether; ester ethers such as butyl corbitol acetate, carbitol acetate, Cellosolve 3-methoxy-butyl acetate, methyl carbitol acetate, methyl Cellosolve and acetate; and a mixture thereof.

Preferable solvents are ethyl acetate, butyl acetate, hexane, toluene, methyl isobutyl ketone, Cellosolve acetate and a mixture thereof.

Resin dissolved in a dispersion solution for the formation of a resin layer is used at an amount of 0.4–20.0 wt. %, preferably 0.9–6.0 wt. %, more preferably 1.0–5.0 wt. % on the basis of the dispersion solution.

If the resin amount is less than 0.4 wt. %, a dispersion and drying process must be repeated many times so that a desired thickness may be obtaind. If the resin amount is more than 20 wt %, a dispersion solution has high viscosity to provide such troubles as the generation of dispersion irregularity and the difficulty in the control of layer thickness.

Metal compounds of low electrical resistance, if added to a resin layer, are used at the addition amount of 10–70 wt. %, preferably 20–60 wt. %, more preferably 30–50 wt. % on the basis of the total amount of a resin layer. The addition amount of the metal compound of less than 10 wt. % can't decrease the electrical resistance of resin layer. The addition amount of the metal compound of more than 70 wt. % results in the strength reduction of the layer and the poor translucence.

An outermost surface layer (1*a*) made of a-C layer has adequate chargeability, excellent translucence, high hardness of about 4H and damage resistance in itself, but when an a-C layer is formed directly on an organic photoconductive layer, the organic photoconductive layer is damaged by plasma to result in the deterioration of photosensitive properties such as the decrease of sensitivity and the increase of residual potential.

When an a-C layer is formed directly on an inorganic photoconductive layer such as a monolayer type of selenium-arsenic alloy, and a laminated type constituted of selenium-tellurium alloy layer on selenium layer, it is liable to peel off at practical use.

A resin layer between a photoconductive layer and a-C layer, although, makes it possible to form a outermost surface with good chargeability, translucence, hardness and so on as making best use of an a - C layer without the degradation of a function of the photoconductive layer.

The amount of hydrogen contained in an a - C layer, which is intended to be not necessarily restrictive, is limited inevitably from a productive aspect to about 5–60 atomic % (hereinafter referred to as "atm. %").

The amount of carbon atom and hydrogen atom contained in an a - c layer can be measured with organic elemental analysis, Auger analysis, SIMS analysis and so on.

An outermost surface (1*a*) of the invention is formed to be 0.01–5 μm, preferably 0.05–2 μm, more preferably 0.1–1 μm in thickness. If the thickness is less than 0.1 μm, the strength of a surface layer is lowered and liable to be injured. If the thickness is more than 5 μm, the translucence is lowered and the radiated light can't be introduced into a photoconductive layer and the sensitivity decreases.

An outermost surface (1*a*) is formed as an a - C layer by the so-called plasma-polymerizing reaction (hereinafter referred to as "P-CVD reaction"), that is, molecules containing at least carbon atoms and hydrogen atoms in the vapor phase undergo discharge decomposition under reduced pressure and a plasma atmosphere. Active neutral seeds or charged seeds generated in the plasma atmosphere are collected on the substrate by diffusing, by charge of electrical or magnetic guiding etc. and deposited as a solid on the substrate through a recombination reaction.

Organic molecules containing at least carbon atoms and hydrogen atoms are not always gas, but may be liquid or solid materials providing that the molecules may be vaporized through melting, vaporization, sublimation, or the like when heated or evacuated.

A hydrocarbon containing at least carbon atoms and hydrogen atoms can be selected from among, for example, saturated hydrocarbons, unsaturated hydrocarbon, alicyclic hydrocarbons, aromatic hydrocarbons.

Examples of the saturated hydrocarbons are methane, ethane, propane, butane, pentane, hexane, heptane, octane, isobutane, isopentane, neopentane, isohexane, neohexane, dimethylbuthane, methylhexane, ethylpentane, dimethylpentane, triptane, methylheptane, dimethylhexane, trimethylpentane, isononane.

Examples of the unsaturated hydrocarbons are ethylene, propylene, isobutylene, butene, petene, methylbutene, hexene, tetramethylethylene, heptene, octene, allene, methylallene, butadiene, pentadiene, hexadiene, cyclopentadiene, ocimene, allo-ocimene, myrcene, hexatriene, acetylene, methlacetylene, butyne, pentyne, hexyne, heptyne, octyne, butadiyne.

Examples of alicyclic hydrocarbons are cyclopropane, cyclobutane, cyclopentane, cyclohexane, cycloheptane, cyclooctane, cyclopropene, cyclobutene, cyclopentene, cyclohexene, cycloheptane, cyclooctene, limonene, terpinolene, phellandrene, silvestrene, thujene, caren, pinene, bornylene, camphene, fenchene, cyclofenchene, tricyclene, bisabolene, zingiberene, curcumene, humulene, cadinene-sesquibenihen, selinene, caryophyllene, santalene, cedrene, camphorene, phyllocladene, podocarprene, mirene etc.

Examples of the aromatic hydrocarbons are benzene, toluene, xylene, hemimellitene, pseudocumene, mesitylene, prehnitene, isodurene, durene, pentamethyl benzene, hexamethyl benzene, ethylbenzene, propyl benzene, cumene, styrene, biphenyl, terphenyl, diphenylemthane, triphenylmethane, dibenzyl, stilbene, indene, naphthalene, tetralin, anthracene and phenanthrene.

Especially, compounds with unsaturated bonds are preferable for the formation of a layer in good quality because they have high reactivity. Butadiene and propylene are particularly preferred in layer-formative properties, easy handling of gases and costs.

Figure 2:
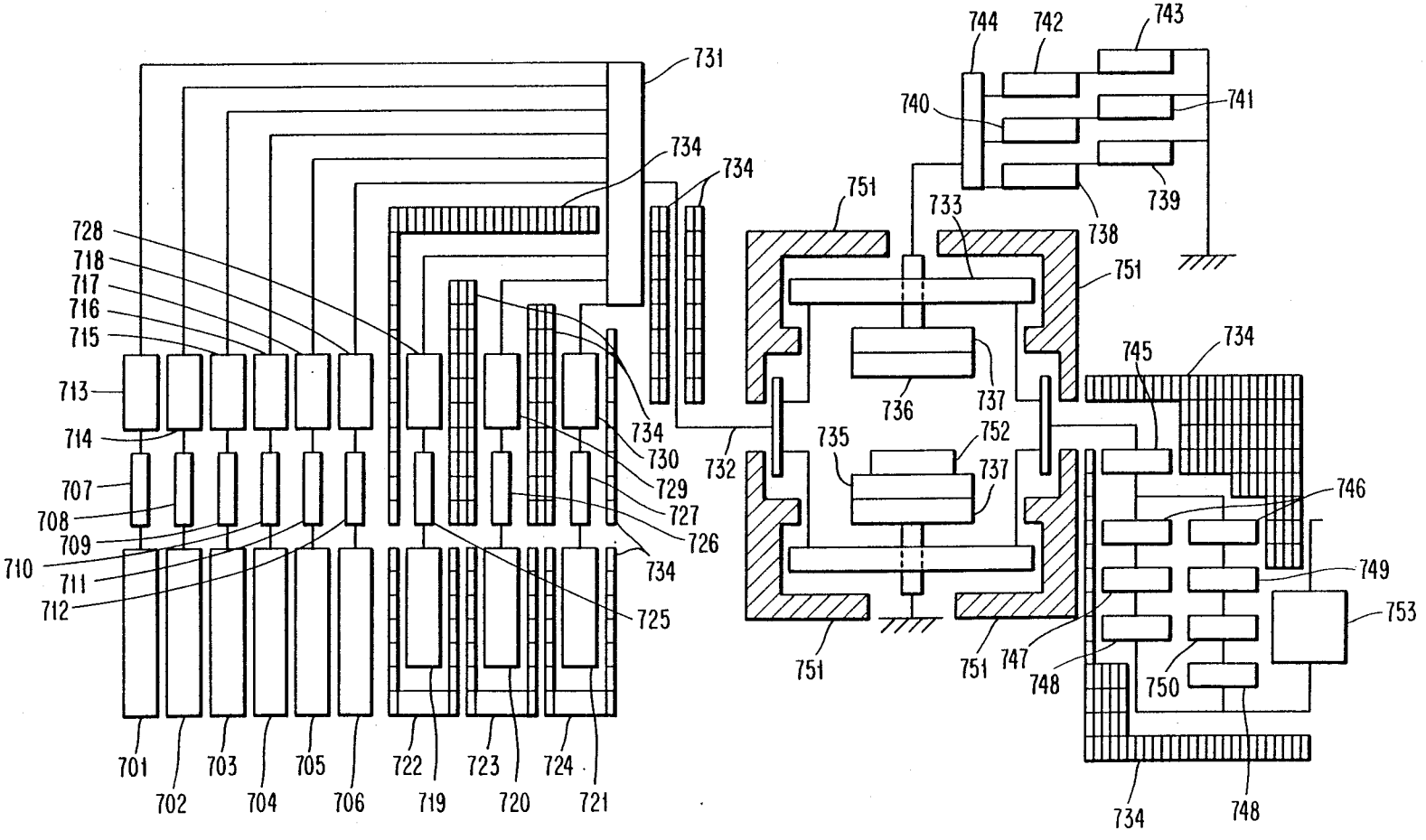
FIG. 2 and FIG. 3 are examples of equipment for the production of a surface protective layer of the invention.
Figure 3:
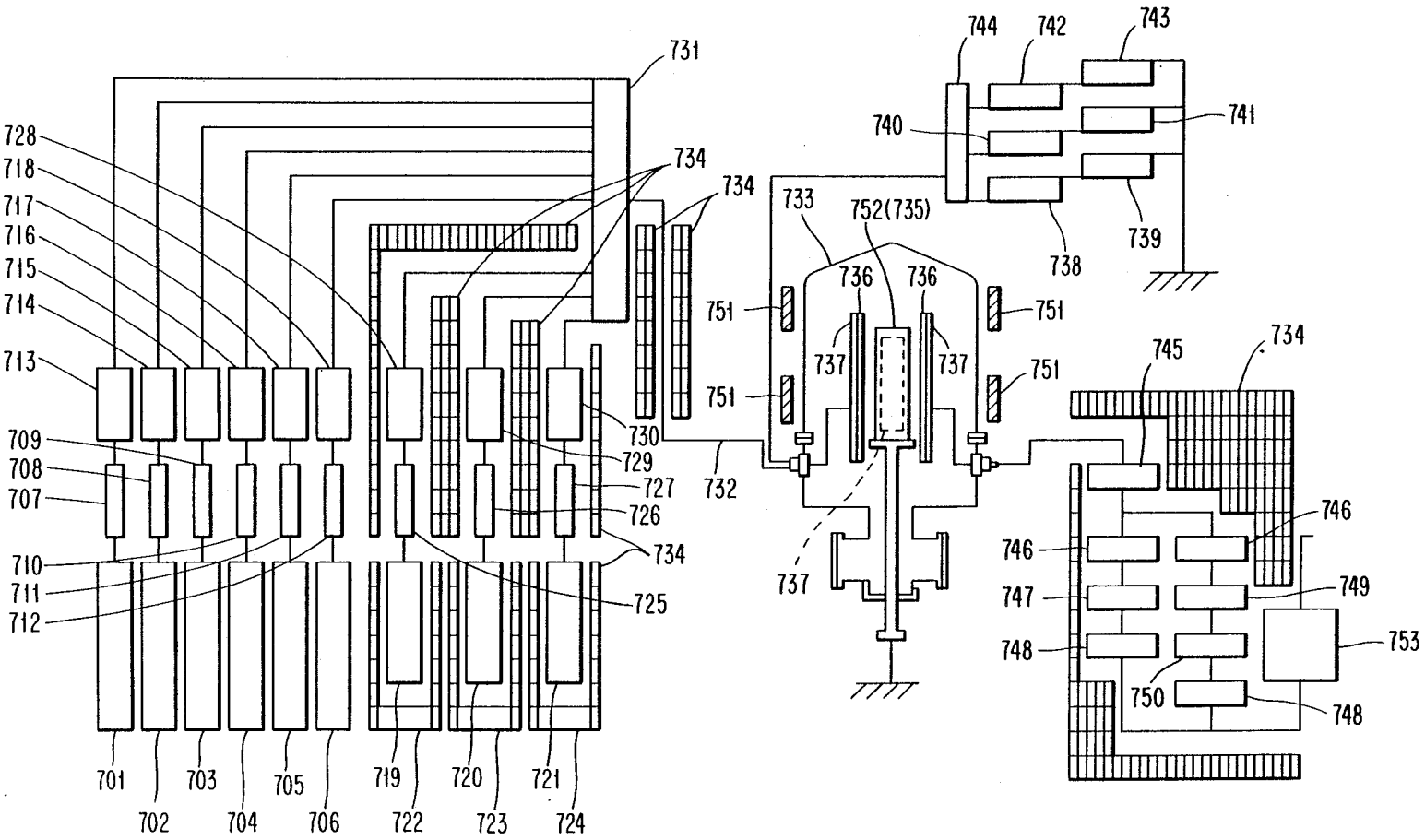

The amount of hydrogen contained in an a - C layer depends on a shape of layer-formation equipment and a condition of layer-formation etc. The content of hydrogen decreases under the conditions such as higher temperature of a substrate, lower reaction pressure, lower dilution ratio of raw materials (hydrocarbon gas) to dilution gas, use of raw materials gas of low hydrogen content higher applied electric power, lower frequency of alternating current, and higher electric field of direct current which added to electric field of alternating current. FIG. 2 and FIG. 3 show examples of glow discharge equipment for the formation of an outermost surface layer of the invention. FIG. 2 is a P - CVD equipment of parallel plate type and FIG. 3 is a P-CVD equipment of cylindrical type.

First, a P - CVD equipment of FIG. 2 is explained.

In FIG. 2, the numerals (701)–(706) denote No. 1 tank through No. 6 tank which are filled with a feedstock (a compound in the vapor phase at normal temperatures) and a carrier gas, each tank connected with one of six regulating valves No. 1 through No. 6 (707)–(712) and one of six flow controllers No. 1 through No. 6 (713)–(718).

Hydrogen gas, argon gas, helium gas and so on are used as a carrier gas.

(719)–(721) show vessels No. 1 through No. 3 which contain a feedstock which is a compound either in the liquid phase or in the solid phase at normal temperature, each vessel being capable of being heated for vaporization by means of one of three heaters No, 1 through No. 3 (722)–(724).

Each vessel is connected with one of three regulating valves No. 7 through No. 9 (725)–(727) and also with one of three flow controllers No. 7 through No. 9 (728)–(730).

These gases are mixed in a mixer (731) and sent through a main pipe (732) into a reactor (733). The piping is equipped at intervals with pipe heaters (734) so that the gases that are vaporized forms of the feedstock compounds in the liquid or solid state at normal temperatures are prevented from condensing or congealing in the pipes.

In the reaction chamber, there is a grounding electrode (735) and a power-applying electrode (736) installed oppositely, each electrode with a heater (737) for heating the electrode.

The power-applying electrode is connected to a high frequency power source (739) with a matching box (738) for high frequency power interposed in the connection circuit, to a low frequency power source (741) likewise with a matching box (740) for low frequency power, and to a direct current power source (743) with a low pass filter (742) interposed in the connection circuit, so that by a connection-selecting switch (744) the mechanism permits application of electric power with a different frequency, such as low frequency electric power of the frequency of 1 KHz-1000 KHz and high frequency electric power of the frequency of 13.56 MHz. Further, direct electric power may be added.

The pressure in the reaction chamber can be adjusted by a pressure control valve (745), and the reduction of the pressure in the reaction chamber can be carried out through an exhaust system selecting valve (746) and by operating a diffusion pump (747) and an oil-sealed rotary vacuum pump (748) in combination or by operating a cooling-elimination device (749), a mechanical booster pump (750) and an oil-sealed rotary vacuum pump in combination.

The exhaust gas is discharged into the ambient air after conversion to a safe unharmed gas by a proper elimination device (753).

The piping in the exhaust system, too, is equipped with pipe heaters at intervals in the pipe lines so that the gases which are vaporized forms of feedstock compounds in the liquid or solid state at normal temperatures are prevented from condensing or congealing in the pipes.

For the same reason the reaction chamber (733), too, is equipped with a heater (751) for heating the chamber, and conductive substrate (752) is put on an electrode.

The heaters above mentioned may not be equipped in consideration of the nature of feedstocks, In particular, organic compounds with −50° C.–+15° C. of boiling point at normal temperature as raw material gasses mostly do not need the heaters and are preferable for the simplification of the production equipment.

Generally, when organic compounds with a boiling point of less than −50° C. are used as raw material gasses, it is desirable to arrange the heaters as above mentioned in order to prevent the generation of fine particles of polymers of raw materials in a chamber (733).

When organic compounds with a boiling point of more than 15° C. are used as raw material gasses, it is also desirable to arrange the heaters in order to prevent the condensation of the raw material gasses in various kinds of pipes.

FIG. 2 illustrates a conductive substrate (752) fixed to a grounding electrode (735), but it may be fixed to the power-applying electrodes (736) and to both the electrodes as well.

An equipment shown in FIG. 3 is basically as same as that shown in FIG. 2. The shape of reaction chamber (733) is changed according to the cylindrical substrate (752). A substrate (752) also plays a role of a grounding electrode (735). The shapes of both an electrical power-applying electrodes (736) and heater for an electrode are cylindrical. A substrate (752) may be rotated by a driving motor (not shown) from the outside.

The reaction chamber for the production of a photosensitive member is preliminarily to a level in the range of about $10^{-4}$ to $10^{-6}$ by the diffusion pump, and then check the degree of vacuum and the gas absorbed inside the equipment is removed by the set procedure. Simultaneously, by the heater for electrode, the electrode and the conductive substrate fixed to the opposing electrode are heated to a given temperature.

As to a substrate, a photosensitive member with a resin layer on an organic photoconductive layer per se known over an electrically conductive substrate may be used, and also may be used an inorganic photoconductive layer of a monolayer type of selenium-arsenic alloy, or a laminated type constituted by selenium-tellurium alloy layer on selenium layer.

When an organic photoconductive layer is used, it is preferable to set the temperature lower then about 100° C. in order to prevent the heat deformation.

Then, from six tanks, No. 1 through No. 6, and from three vessels, No. 1 through No. 3, gases of the raw materials are led into the reaction chamber by regulating the gas flows at constant rates using the nine flow controllers, No. 1 through No. 9 and simultaneously the pressure in the reaction chamber is reduced constantly to a specified level of about 0.05 Torr–5 Torr by a pressure regulating valve.

After the gas flows have stabilized, the connection-selecting switch is put in position for, for example, the low frequency power source so that low frequency power is supplied to the power-applying electrode. An electrical discharge begins between the two electrodes and an a - C layer in the solid state is formed on the conductive substrate with time.

Preferable layer depositing rate is 10 Å/min.—3 μm/min, preferably 100 Å/min.—1 μm/min., more preferably 500 Å/min.—5000 Å/min.. The layer depositing rate of lower than 10 Å/min. is not preferable from the view point of the productivity. The layer depositing rate of higher than 3 μm/min is not preferable in that the layer roughness occurs at high probability and that it becomes difficult to form an uniform layer.

When the layer is deposited to a specified thickness, the electric discharge is stopped and a photosensitive member with a - C layer as an outermost surface layer is obtained.

An outermost surface layer of an a - C layer of the invention may be incorporated by hetero atoms other than carbon and hydrogen, for example, halogen atoms such as fluorine, chlorine and bromine, oxygen, nitrogen, atoms in Group III (B, Al, Ga, In, etc.) which control the electric conductivity, atoms in Group V (P, As, Sb, etc.) which also control the electric conductivity.

The incorporation of halogen atoms effects the improvement of the surface slip characteristics and the filming resistance of the surface protective layer. The incorporation of fluorine atoms is particularly effective.

It is recognized that the incorporation of oxygen atoms or nitrogen atoms effects the improvement of humidity resistance, probably because weak bonds are cut forcibly followed by the strong bond formation between nitrogen atoms and carbon atoms or between oxygen atoms and carbon atoms which is effective for the prevention of the water adhesivity.

Atoms in Group V and Group III are incorporated so that the surface side may be relatively N-type (Group V) and P-type (Group III). Then, anti-bias effect is achieved and it improves chargeability, the lowering of dark-decrease of charges and sensitivity.

The incorporation of atoms in Group IV increases the hardness to give damage resistance to a photosensitive member and effects the improvement of humidity resistance.

The incorporation of atoms in Group IV is also effective for the cutting of harmful light with short wavelength, and so a photosensitive member which gets fatigued by the light can have the advantages of the incorporation.

A plurality of these hetero atoms can be used together, and they may be incorporated at some specific position in an outermost surface layer of an a - C layer according to the purpose, and can have a density gradient, or in some other specific manner.

In order to incorporate hetero atoms such as halogen atom, oxygen atom, nitrogen atom, atoms of Group III in the periodic table, atoms of Group IV in the periodic table or atoms of Group V in the periodic table, those hetero atoms-containing compounds in a vaporized condition are made to undergo plasma conditions together with vaporized hydrocarbon compounds.

Organic compounds for the production of an A - C layer are not always gas, but may be liquid or solid materials providing that the materials man be vaporized through melting, vaporization, sublimation or the like when heated or evacuated.

Molecules containing at least a halogen atom are exemplified by fluorine, chlorine, bromine, iodine, hydrogen fluoride, hydrogen chloride, hydrogen bromide, hydrogen iodide, methyl fluoride, methyl chloride, methyl bromide, methyl iodide, ethyl fluoride, propyl fluoride, buthyl fluoride, amyl fluoride, fluorobenzene, chlorobenzene, fluorostyrene, fluoroform, chloroform, tetrafluorocarbon, tetrachlorocarbon, vinylidene chloride, perfluoroethylene, perfluoropropane, perfluoropropene, and a mixture thereof.

Molecules containing at least an oxygen atom are exemplified by oxygen, steam (water), nitrous oxide, carbon monoxide, carbon dioxide, methanol, ethanol, formaldehyde, acetaldehyde, formic acid, acetic acid, acetone, ethyl methyl ketone, methyl ether, ethyl ether, propyl ether, vinyl ether, ethylene oxide, dioxane, ethyl formate, methyl acetate, furan, oxadiazole, and a mixture thereof.

Molecules containing at least a nitrogen atom are exemplified by nitrogen, ammonium, nitrous oxide, nitrogen monoxide, nitrogen dioxide, methyl amine, trimethyl amine, ethyl amine, hydrazine, aniline, methyl aniline, toluidine, benzyl amine, ethylenediamine, acetonitrile, pyrrole, oxazole, thiazole, imidazole, pyridine, oxadine, carbazole, phenanthridine and imidazothiazole.

Molecules containing, at least, an atom of the group III in the periodic table are exemplified by $B_2H_6$, $BCl_3$, $BBr_3$, $BF_3$, $B(O_2H_5)_3$, $AlCl_3$, $Al(CH_3)_3$, $Al(Oi—C_3H_7)_3$, Ga $(C_2H_5)_3$, and $In(C_2H_5)_3$.

Molecules containing, at least, an atom of Group IV in the periodic table are exemplified by $SiH_4$, $Si_2H_6$, $(_2H_5)_3SiH$, $SiF_4$, $SiH_2Cl_2$, $Si_2F_2H_2$, $SiCl_4$, $Si(OCH_3)_4$, $Si(OC_2H_5)_4$, $Si(OC_3H)_4$, $GeH_4$, $GeCl_4$, $GeF_4$, $Ge_2H_6$, $Ge(OCH_3)_4$, $Ge(OC_2H_5)_4$, $Ge(C_2H_5)_4$, $(CH_3)_4Sn$, $Sn(OCH_3)_4$, $(C_2H_5)_4Sn$, $SnCl_4$.

Molecules containing at least an atom of Group V in the periodic table are exemplified by $PH_3$, $PF_3$, $PF_5$, $PCl_2F$, $PCl_2F_3$, $PCl_3$, $PBr_3$, $PO(OCH_3)_3$, $P(C_2H_5)_3$, $POCl_3$, $AsH_3$, $AsCl_3$, $AsBr_3$, $AsF_3$, $AsF_5$, $AsCl_3$, $SbH_3$, $SbF_3$, $SbCl_3$, $Sb(OC_2H_5)_3$.

The amount of those hetero atoms incorporated in an a - C layer can be adjusted by the increase or decrease of hetero atom-containing molecules used in a plasma CVD reaction. A hetero atom may be incorporated at various content along the depth of an a - C layer by adjustment of flow rate of the hetero atom-containing molecules at the Plasma CVD reaction.

The incorporation of hetero atoms of at least 0.1 atm. % is needed to take advantage of the incorporation effects above mentioned. The maximum amount of hetero atom is not restricted in particular but determined inevitably from the view point of the production method of glow discharge.

The amount of hetero atoms incorporated in an a - C layer is measured by, for example, Auger analysis, organic elemental analysis and so on.

EXAMPLE 1

A photoconductive layer of monolayer type of selenium-arsenic alloy was formed to be 50 μm on an electrically conductive and cylindrical aluminium substrate (80 mm in diameter×330 mm in length). A silicon resin layer was formed on the photoconductive layer by spray-coating of a solution containing 2.5 wt % of silicon resin (KR214; made by Shin-etsu Kagaku K.K.) and 97.5 wt. % of ethyl acetate so that the layer thickness may be 0.15 μm after dried at 85° C. of temperature for 1 hour.

Then, an outermost surface layer of a - C layer was formed on the resultant silicon resin layer with a glow-discharge decomposition equipment shown in FIG. 3.

First the reaction chamber (733) was evacuated inside to a high level of approximately $10^{-6}$ Torr, and then by opening No. 1 and No. 2 regulating valves (707) and (708), hydrogen gas from No. 1 tank (701) and butadiene gas from No. 2 tank (702) were led, under output pressure gage reading of 1 Kg/cm$^2$, into mass flow controllers (713) and (714). Then, the mass flow controllers were set so as to make hydrogen flow at 100 sccm and butadiene flow at 60 sccm, and the gasses were allowed into the reaction chamber(733) from the main pipe (732) through the mixer (731). After the respective flows had stabilized, the internal pressure of the reaction chamber (733) was adjusted to 0.5 Torr. On the other hand, the electrically conductive and cylindrical aluminium substrate (752) with monolayer type of selenium-arsenic alloy was preliminarily heated up to 50° C. for about 15 minutes before the gas introduction.

While the gas flows and the internal pressure were stabilized, it was connected to the low frequency power source (741) and 130 watts power (frequency; 150 KHz) was applied to the power-applying electrode (736). After plasma polymerization for approximately for 2 minutes, there was formed an outermost surface layer of an a - C layer with a thickness of approximately 0.15 μm over the substrate (752).

After the layer formation, the electric power supply was stopped. The regulating valves except for the hydrogen gas valve were closed. Hydrogen gas was only introduced to the reaction chamber (733) at the flow rate of 20 sccm so that the pressure inside may be maintained at 10 Torr.

After the temperature inside the chamber was decreased to 30° C. for about 15 minutes, the regulating valve for hydrogen gas was closed so that the reaction chamber (733) might be evacuated, and then the vacuum of the reaction chamber (733) was relaxed to take out a photosensitive member with the surface protective layer of the invention.

The resultant a - C layer was analyzed by organic analysis and Auger analysis to find hydrogen contained at 43 atm.% on the basis of all atoms constituting the a - C layer.

Evaluation of the photosensitive member

The pencil hardness of the surface of the resultant photosensitive member was measured according to JIS-K-5400 to obtain around 6 H. It was understood that the photosensitive member was hardened by the formation of the surface protective layer.

JIS-K-5400 was carried out as described below.

(Summary)

JIS-K-5400 which is the Pencil Scratch Test is to examine the scratch resistance of a coat to various hardness of a core of pencil from the view point of breaks of the coat.

(Scratch Tester)

Figure 4:
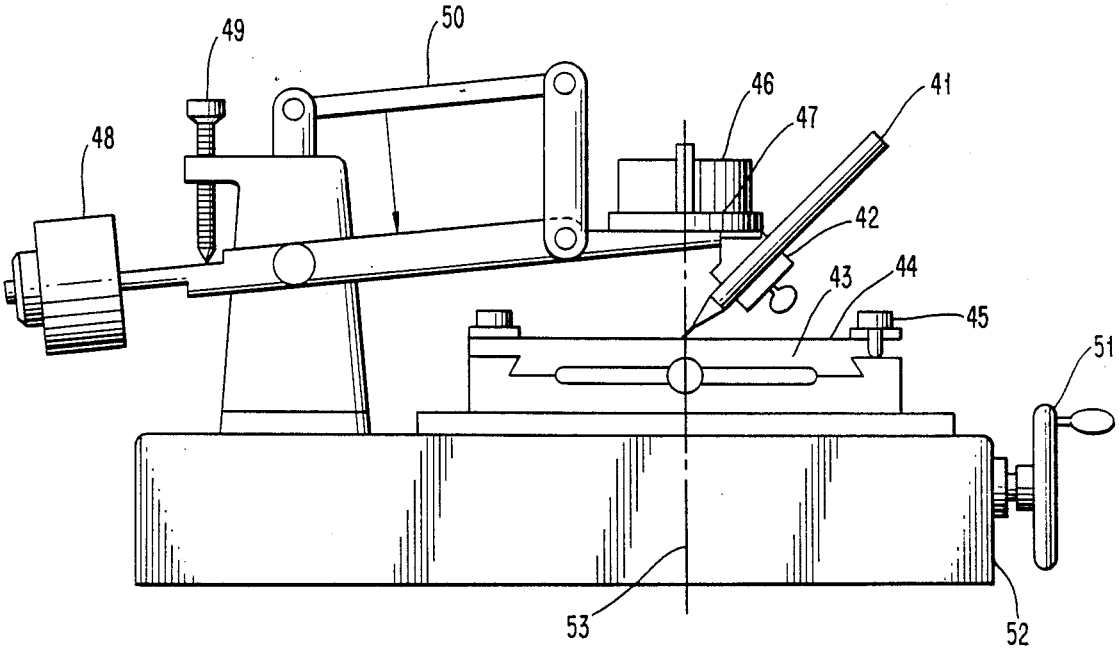
FIG. 4 is a schematic view of a pencil scratching tester for coatings.

It is useful for the examination of JIS-K-5400 to use a scratch tester specified in JIS-K-5401. The schematic view thereof is shown in FIG. 4.

(Pencil for Test)

Pencils which are specified in JIS-S-6006, produced by the same company and have properties suitable for the test should be used. The order of symbols of pencil hardness is 9H, 8H, 7H, 6H, 5H, 4H, 3H, 2H, H, F, HB, B, 2B, 3B, 4B, 5B, 6B. 9H is the hardest and 6B is the softest. The harder it is, the higher it shall be. (There is provided a set of pencils of every pencil hardness suitable for the invention which are selected by the foundation of NIPPON TORYO KENSA KYOKAI).

A wooden part of the pencil is shaved to bare a cylindrical core of 3 mm in length, and then the core is pressed perpendicularly against a sheet of sand paper of No. 400 specified JIS-R-6252 to be sharpened silently as it describes circles so that the tip of the core may be flat and the edge thereof may be sharp. The tip of the pencil is re-sharpened before every scratch test.

(Method of Test)

Test specimens are prepared by applying a sample onto one side of a steel plate (about 150×70×1 mm), drying it, and then leaving it for 24 hours in a desiccator. The test specimen(44) is put horizontally on the table (43) for the specimen installation (45) in a tester of pencil scratch assembled on a base (52) so that the sample-applied side may be directed to the air side. The table (43) for the specimen installation (45) is made so that it can move along a straight line on the horizontal plane. The line is called the "movement direction".

A pencil (41) is installed in a pencil holder (42) so that the tip of the pencil may be brought into contact with the test specimen (44) at a point where a perpendicular line (53) going through the gravity center of the weight of the tester crosses the coated plane and that the angle between the axis of the pencil and the line which goes through the point and is contained in the perpendicular plane to the coated plane containing the movement direction may be 45 degrees. After a balancing weight (48) is adjusted so that the load of pencil onto the test specimen may be neither positive nor negative, a setscrew (49) is fastened, the pencil is separated from the coated plane, and the beam (50) is fixed.

The weight of 1.5±0.05 kg is loaded on a weight pan (47), the setscrew (49) is unfasten, the core of the pencil is contacted with the coated plane, and then the weight is loaded ar the edge of the pencil.

Then, a handle (51) is rotated at a constant rate, the test specimen is moved about 3 mm horizontally in a direction opposite that of the core to investigate whether the coating is broken. The speed of movement shall be about 0.5 mm per second.

The specimen is shifted at a right angle to the movement direction, and subjected to scratching 5 times at the different positions. If the breaks which reach to the surface of the steel plate of the specimen are recognized two or more times, the scratch test is carried out similarly with a pencil of one lower ranking hardness. When the breaks that reach to the surface are recognized less than two times after 5 scratches, the symbol of pencil hardness is recorded. If the breaks which reach to the surface the steel plate of the specimen are recognized less than two times, the scratch test is carried out similarly with a pencil of one higher ranking hardness. When the breaks that reach to the surface are recognized two or more times after 5 scratches, the symbol of pencil hardness is recorded.

(Judgement)

A set of two pencils with the symbols next to each other result when one pencil is obtained as above mentioned from the view point that the breaks are recognized two times or more, and the other pencil is obtained from the view point that the breaks are recognized less than two times. The symbol of the latter pencil hardness shall be the pencil scratch value of the coatings.

The adhesion properties were also evaluated by cross-cut adhesion test according to JIS-K-5400 to get 10 points. It was understood that the surface protective layer of the invention was excellent in adhesivity.

The resultant photosensitive member was charged to the potential of +600 V with 6.7 kV power of a charger according to the usual Carlson process, and the sensitivity to white light was measured to get about 0.97 lux-sec of an exposure value for a half reducing ($E_{\frac{1}{2}}$), which is a necessary exposure amount for the surface potential to be the half value of the initial surface potential. It was confirmed that a surface protective layer of the photosensitive member of the invention did not deteriorate the original sensitivity of a photosensitive member of monolayer type made of selenium-arsenic alloy, which showed a sensitivity ($E_{\frac{1}{2}}$) of about 0.91 lux·sec before the formation of the surface protective layer.

The photosensitive member was left under an environment for 6 hours that the low temperature and low humidity atmosphere of 10° C. temperature and 30% of relative humidity, and the high temperature and high humidity atmosphere of 50° C. of temperature and 90% of relative humidity were repeated by alternating turns at 30 minute intervals.

The peeling off or the cracking of the surface protective layer was not observed and it was understood that the surface protective layer of the invention was excellent in practical adhesivity with the photoconductive layer of to monolayer type made of selenium-arsenic alloy.

The obtained photosensitive member was installed and used in the copying machine EP 650Z made by Minolta Camera K.K. to evaluate copying resistance when provided to the developing process. It gave clear copy images in that image flows were not observed when it was used in the developing process under conditions of 35° C. of temperature and 80% of relative humidity. The contact of the photosensitive member with developers, sheets of copying paper and cleaning members in the copying machine did not cause the peeling off of the surface protective layer.

Even after 250000 sheets of paper were developed with the copying machine in usual circumstances, clear images were always formed . Further, selenium or arsenic etc. were not detected by the surface composition analysis according to Auger analysis after the practical development of 250000 sheets of paper.

Accordingly, it was confirmed that a surface protective layer of the invention could achieve the improvement of the durability and the decease of poisonous harm without the deterioration of image quality.

EXAMPLE 2

A photosensitive member was prepared similarly as Example 1, except that the electrically conductive and cylindrical aluminium substrate (80 mm in diameter×330 mm in length) with a photoconductive layer of laminated type constituted of a selenium-tellurium alloy layer on a selenium layer over the substrate. The photoconductive layer had 50 μm in thickness and was prepared with vacuum depositing equipment according to the usual methods.

Properties

The resultant photosensitive member had similar properties as those of the photosensitive member of Example 1. Further, selenium, tellurium, and so on were not detected from a cleaning blade used during the copying resistance test or from wasted toners.

Accordingly, it was confirmed that a surface protective layer of the invention could achieve the improvement of the durability and the decrease of poisonous harm without the deterioration of image quality.

EXAMPLE 3

A photosensitive member was prepared similarly as Example 1 except that a resin layer was formed by a dipping method with a solution for coating so that the layer thickness after drying might be about 0.2 μm. The solution for coating was prepared by adding acrylic polyol(Acrydick A808: made by Dainippon Ink K.K.) of 2.0 wt. % and isocyanate compound (Barnock DN950; made by Dainippon Isocyanate K.K.) of 1.9 wt. % to a mixed solvent of methyl ethyl ketone of 76.1 wt % with Isoper H (Esso chemical Co.,) of 20 wt. % and then being stirred for 1 hour.

Properties

The resultant photosensitive member had similar properties as those of the photosensitive member of Example 1. Further, selenium, arsenic and so on were not detected from a cleaning blade used during the copying resistance test or from wasted toners.

Accordingly, it was confirmed that a surface protective layer of the invention could achieve the improvement of the durability and the decrease of poisonous harm without the deterioration of image quality.

EXAMPLE 4

A photosensitive member was prepared similarly as Example 3, except that the electrically conductive and cylindrical aluminium substrate (80 mm in diameter×330 mm in length) with a photoconductive layer of a laminated type constituted of a selenium-tellurium alloy layer on a selenium layer over the substrate. The photoconductive layer was prepared with vacuum depositing equipment according to the usual methods to be 50 μm in thickness.

Properties

The resultant photosensitive member had similar properties as those of the photosensitive member of Example 1. Further, selenium, tellurium and so on were not detected from a cleaning blade used during the copying resistance test or from wasted toners.

Accordingly, it was confirmed that a surface protective layer of the invention could achieve the improvement of the durability and the decrease of poisonous harm without the deterioration of image quality.

EXAMPLE 5

A photosensitive member was prepared similarly as Example 1 except that phosphine gas diluted to 10% with hydrogen gas was further fed at the flow rate of 100 sccm through No. 4 tank (704).

The resultant a - C layer was analyzed by organic quantitative analysis and Auger analysis to find hydrogen contained at 42 atm. % and phosphorus at a maximum of 1.0 atm. % along the depth of the layer on the basis of all atoms constituting the a - C layer.

The charger needed the power of +5.2 kV in order to charge the resultant photosensitive member to the level of +600 V according to the usual Carlson process.

Therefore, it was understood that the chargeability was improved because the addition of an atom of Group V in the periodic table (phosphorus) enabled the charging of the photosensitive member to the level of +600 V with less power. Other properties are the same as those of Example 1.

EXAMPLE 6

A photosensitive member was prepared similarly as Example 5, except that the electrically conductive and cylindrical aluminium substrate (80 mm in diameter×330 mm in length) with a photoconductive layer of a laminated type constituted of a selenium-tellurium alloy layer on a selenium layer over the substrate. The photoconductive layer was prepared with vacuum depositing equipment according to the usual methods to be 50 μm in thickness. The resultant photosensitive member had the some properties as those of Example 5.

EXAMPLE 7

A photosensitive member was prepared similarly as Example 5 except that a resin layer was formed by a dipping method with a solution for coating so that the layer thickness after drying might be about 0.2 μm. The solution for coating was prepared by adding acrylic polyol(Acrydick A808: made by Dainippon Ink K.K.) of 2.0 wt. % and isocyanate compound (Barnock DN950; made by Dainippon Isocyanate K.K.) of 1.9 wt. % to a mixed solvent of methyl ethyl ketone of 76.1 wt. % with Isoper H (Esso chemical Co.,) of 20 wt. % and then being stirred for 1 hour. The resultant photosensitive member had the same properties as those of Example 5.

EXAMPLE 8

A photosensitive member was prepared similarly as Example 7, except that the electrically conductive and cylindrical aluminium substrate (80 mm in diameter×330 mm in length) with a photoconductive layer of laminated type constituted of a selenium-tellurium alloy layer on a selenium layer over the substrate. The photoconductive layer was prepared with vacuum depositing equipment according to the usual methods to be 50 μm in thickness. The resultant photosensitive member had the same properties as those of Example 5.

EXAMPLE 9

A photoconductive layer of a monolayer type of selenium-arsenic alloy was formed with vapor-depositing equipment to be 50 μm in thickness according to the usual methods on an electrically conductive and cylindrical aluminium substrate (80 mm in diameter×330 in length). An epoxy resin layer was formed on the photoconductive layer by spray-coating a solution containing 3.5 wt. % of epoxy resin (Epiculone 1050: made by Dainippon K.K.) and 96.5 wt. % of toluene so that the layer thickness might be about 0.2 μm after drying at 80° C. of temperature for 1 hour.

Then, an outermost surface layer of a - C layer was formed on the resultant epoxy resin layer with the glow-discharge decomposition equipment shown in FIG. 3.

First, the reaction chamber (733) was evacuated inside to a high level of approximately $10^{-6}$ Torr, and then by opening No. 1 and No. 2 regulating valves (707) and (708), hydrogen gas from No. 1 tank (701) and propylene gas from No. 2 tank (702) were fed, under output pressure gage reading of 1 Kg/cm$^2$, into mass flow controllers (713) and (714). Then, the mass flow controllers were set so as to make hydrogen flow at 250 sccm and propylene flow at 60 sccm, and the gasses were allowed into the reaction chamber(733) from the main pipe (732) through the mixer (731). After the respective flows had stabilized, the internal pressure of the reaction chamber (733) was adjusted to 2.0 Torr. On the other hand, the electrically conductive and cylindrical aluminium substrate (752) with a monolayer of selenium-arsenic alloy was preliminarily heated up to 70° C. for about 15 minutes before the gas introduction.

While the gas flows and the internal pressure were stabilized, it was connected to the low frequency power source (741) and 100 watts power (frequency; 150 KHz) was applied to the power-applying electrode (736). After plasma polymerization for approximately about 1 minute and 20 seconds, there was formed an outermost surface layer of an a - C layer with a thickness of approximately 0.15 μm over the substrate (752).

After the layer formation, the electric power supply was stopped. The regulating valves except for the hydrogen gas valve were closed. Hydrogen gas was only introduced to the reaction chamber (733) at the flow rate of 20 sccm so that the pressure inside may be maintained at 10 Torr.

After the temperature inside the chamber was decreased to 30° C. for about 15 minutes, the regulating valve for hydrogen gas was closed to allow the reaction chamber (733) to be evacuated inside, and then the vacuum of the reaction chamber (733) was released to take out a photosensitive member with the surface protective layer of the invention.

The resultant a - C layer was analyzed by organic analysis and Auger analysis to find hydrogen contained at 43 atm. % on the basis of all atoms constituting the a - C layer.

Properties

The resultant photosensitive member had similar properties as those of the photosensitive member of Example 1. Further selenium, arsenic and so on were not detected from a cleaning blade used during the copying resistance test or from wasted toners.

Accordingly, it was confirmed that a surface protective layer of the invention could achieve the improvement of the durability and the decrease of poisonous harm without the deterioration of image quality.

EXAMPLE 10

A photosensitive member was prepared similarly as Example 9, except that the electrically conductive and cylindrical aluminium substrate (80 mm in diameter×330 mm in length) with a photoconductive layer of laminated type constituted of a selenium-tellurium alloy layer on a selenium layer over the substrate. The photosensitive layer was prepared with vacuum depositing equipment according to the usual methods to be 50 μm in thickness.

Properties

The resultant photosensitive member had similar properties as those of the photosensitive member of Example 1. Further, selenium, tellurium and so on were not detected from a cleaning blade used during the copying resistance test or from wasted toners.

Accordingly, it was confirmed that a surface protective layer of the invention could achieve the improvement of the durability and the decrease of poisonous harm without the deterioration of image quality.

EXAMPLE 11

A photosensitive member was prepared similarly as Example 9 except that a resin layer was formed by a dipping method with a solution for coating so that the layer thickness after drying might be about 0.15 μm. The solution for coating was prepared by adding thermosetting acrylic resin (HR 620; made by Mitsubishi Reiyon K.K.) of 2.8 wt. % and melamine resin (Uban 20HS: made by Mitsui Toatsu K.K.) of methyl isobuthyl ketone with Cellosolve acetate (1:1) and then being stirred for 1 hour.

Properties

The resultant photosensitive member had similar properties as those of the photosensitive member of Example 1. Further, selenium, arsenic and so on were not detected from a cleaning blade used during the copying resistance test or from wasted toners.

Accordingly, it was confirmed that a surface protective layer of the invention could achieve the improvement of the durability and the decrease of poisonous harm without the deterioration of image quality.

EXAMPLE 12

A photosensitive member was prepared similarly as Example 9, except that the electrically conductive and cylindrical aluminium substrate (80 mm in diameter×330 mm in length) with a photoconductive layer of laminated type constituted of a selenium-tellurium alloy layer on a selenium layer over the substrate. The photoconductive layer was prepared with vacuum depositing equipment according to the usual methods to be 50 μm in thickness.

Properties

The resultant photosensitive member had similar properties as those of the photosensitive member of Example 1. Further, selenium, tellurium and so on were not detected from a cleaning blade used during the copying resistance test or from wasted toners.

Accordingly, it was confirmed that a surface protective layer of the invention could achieve the improvement of the durability and the decrease of poisonous harm without the deterioration of image quality.

EXAMPLE 13

A photoconductive layer of a monolayer type of selenium-arsenic alloy was formed with vapor-depositing equipment to be 50 μm in thickness according to a usual method on an electrically conductive and cylindrical aluminium substrate (80 mm in diameter×330 mm in length). An epoxy resin layer was formed on the photoconductive layer by the spray-coating of a solution containing 3.5 wt. % of epoxy resin (Epiculone 1050: made by Dainippon K.K.) and 96.5 wt. % of toluene so that the layer thickness might be about 0.2 μm after dried at 80° C. of temperature for 1 hour.

Then, an outermost surface layer of a - C layer was formed on the resultant epoxy resin layer with the glow-discharge decomposition equipment shown in FIG. 3.

First, the reaction chamber (733) was evacuated inside to a high level of approximately $10^{-6}$ Torr, and then by opening No. 1, No. 2 and No. 3 regulating valves (707), (708) and (709), hydrogen gas from No. 1 tank (701) and butadiene gas from No. 2 tank (702) and tetrafluorocarbon gas from No. 3 tank were fed, under an output pressure gauge reading of 1 Kg/cm$^2$, into mass flow controllers (713), (714) and (715). Then, the mass flow controllers were set so as to make hydrogen flow at 100 sccm and butadiene gas flow at 60 sccm, and tetrafluorocarbon gas at 120 sccm and the gasses were allowed into the reaction chamber(733) from the main pipe (732) through the mixer (731). After the respective flows had stabilized, the internal pressure of the reaction chamber (733) was adjusted to 0.5 Torr. On the other hand, the electrically conductive and cylindrical aluminium substrate (752) with a monolayer type of selenium-arsenic alloy was preliminarily heated up to 50° C. for about 15 minutes before the gas introduction.

While the gas flows and the internal pressure were stabilized, it was connected to the low frequency power source (741) and 150 watts power (frequency; 100 KHz) was applied to the power-applying electrode (736). After plasma polymerization for approximately about 1 minute, there was formed an outermost surface layer of an a - C layer with a thickness of approximately 0.10 μm over the substrate (752).

After the layer formation, the electric power supply was stopped. The regulating valves except for the hydrogen valve gas were closed. Hydrogen gas was only introduced to the reaction chamber (733) at the flow rate of 20 sccm so that the pressure inside might be maintained at 10 Torr.

After the temperature inside the chamber was decreased to 30° C. for about 15 minutes, the regulating valve for hydrogen gas was closed so that the reaction chamber (733) could be evacuated inside, and then the vacuum of the reaction chamber (733) was released to take out a photosensitive member with the surface protective layer of the invention.

The resultant a - C layer was analyzed by organic analysis and Auger analysis to find hydrogen contained at 40 atm. % and fluorine at 3.7 atm. % on the basis of all atoms constituting the a - C layer.

Evaluation of the photosensitive member

The pencil hardness of the surface of the resultant photosensitive member was measured according to JIS-K-5400 to obtain around 6H. It was understood that the photosensitive member was hardened by the formation of the surface protective layer.

The adhesion properties were also evaluated by cross-cut adhesion test according to JIS-K-5400 to get 10 points. It was understood that the surface protective layer of the invention was excellent in adhesivity.

The resultant photosensitive member was charged to the potential of +600 V with 6.8 kV power of a charger according to the usual Carlson process, and the sensitivity to white light was measured to get about 0.96 lux.sec of $E_{\frac{1}{2}}$. It was confirmed that a surface protective layer of the photosensitive member of the invention did not deteriorate the original sensitivity of a photosensitive member of a monolayer type made of selenium-arsenic alloy, which showed a sensitivity of about 0.90 lux.sec of $E_{\frac{1}{2}}$ before the formation of the surface protective layer.

The photosensitive member was left under an environment for 6 hours that the low temperature and low humidity atmosphere of 10° C. temperature and 30% of relative humidity, and the high temperature and high humidity atmosphere of 50° C. of temperature and 90% of relative humidity were repeated by alternating turns at 30 minute intervals.

The peeling off or the cracking of the surface protective layer was not observed and it was understood that the surface protective layer of the invention was excellent in practical adhesivity with the photoconductive layer of a monolayer type made of selenium-arsenic alloy.

The obtained photosensitive member was installed in the really used copying machine EP 650Z made by Minolta Camera K.K. to evaluate copying resistance when provided to the developing process. It gave clear copy image in that image flows were not observed when it was used in the developing process under conditions of 35° C. of temperature and 80% of relative humidity. The contact of the photosensitive member with developers, sheets of copying paper and cleaning members in the copying machine did not cause the peeling off of the surface protective layer.

Even after 250000 sheets of paper were developed with the copying machine in usual circumstances, clear images were always formed . Further, selenium or arsenic etc. were not detected by the surface composition analysis according to Auger analysis after the practical development of 250000 sheets of paper.

Filming phenomena were not observed on the surface of the photosensitive member and the slip characteristics of the surface was good.

Accordingly, it was confirmed that a surface protective layer of the invention could achieve the improvement of the durability and the decrease of poisonous harm without the deterioration of image quality.

COMPARATIVE EXAMPLES 1 and 2

An outermost surface protective layer was formed on two kinds of photoconductive layer except that resin layers were not formed. One photoconductive layer is a monolayer type of selenium-arsenic alloy and the other is a laminated type constituted of selenium-tellurium layer on selenium layer over the substrate.

It was understood that the adhesivity was improved according to the invention because the adhesivity was 2 points when measured by the cross-cut adhesion test for the surface of the resultant photosensitive member according to JIS-K-5400.

EXAMPLE 14

Titanyl phthalocyanine was vapor-deposited on a cylindrical aluminium substrate (80 mm in diameter×330 mm in length) to form a charge generating layer of 2500 Å in thickness under such conditions that the boat temperature was 400°-500° C. and the vacuum degree was $10^{-4}$-$10^{-6}$ Torr according to a resistance heat method.

A charge transporting layer was formed on the charge generating layer by applying a solution containing p-bisdiethylamino-tetraphenyl butadiene (referred to as Japanese Patent KOKAI No. 30255/1987) of 1 part by weight and polycarbonate (K-1300; made by Teijin Kasei K. K.) of 1 part by weight dissolved in tetrahydrofuran (THF) of 6 parts by weight so that the layer thickness after drying might be 15 μm.

A resin layer was formed on the charge transporting layer by applying the solution of polycarbonate (the same one as above used) of 1 part by weight dissolved in THF of 10 parts by weight so that the layer thickness after drying might be 0.1 μm.

And then an outermost surface layer of organic plasma-polymerized layer was formed with plasma polymerization equipment shown in FIG. 3 under such conditions as shown below;

| | |
|---|---|
| Used gas | |
| hydrogen gas | 300 sccm |
| butadiene gas | 10 sccm |
| tetrafluoro carbon | 10 sccm |
| Conditions of layer formation | |
| pressure | 0.3 Torr |
| power supply; | |
| low frequency power | |
| frequency | 30 KHz |
| power | 350 W |
| substrate temperature | 70° C. |
| layer formation time | 10 minutes |
| layer thickness | 1000 Å |

Evaluation

Electrostatic properties, copying resistance and electrostatic properties after the copying resistance test were evaluated for the resultant photosensitive member.

As to the electrostatic properties the photosensitive member was installed in the copying machine for electrophotography (EP-470Z made by Minolta Camera K.K.) the light source of which was exchanged to a laser light source(780 nm of wavelength), to measure the initial surface potential (Vo) when corona-charged with the power of −6.2 KV, the light exposure value $E_{\frac{1}{2}}$(erg/cm$^2$) and the residual potential Vr(V) when irradiated with 60 (lux sec) of halogen lamp of color temperature of 2200° K. As to the copying resistance test, image qualities were evaluated after 1, 5000, 7000, 10000, 20000, 40000, 50000, 70000, 100000 sheets of paper were developed with the EP-470Z. The ranks of image qualities were represented by the symbols "o", "Δ", "x":

"O" means that good images were formed without the lowering of image density and the generation of fogs.

"Δ" means that image density lowered or fogs generated.

"X" means that image density lowered remarkably or fogs generated remarkably.

Vo, $E\frac{1}{2}$, and Vr were measured again after the copying resistance test.

The results were shown in Table 1.

EXAMPLE 15

A charge transporting layer was formed on a cylindrical aluminium (80 mm in diameter×330 mm in length) by applying the solution of the styryl compound with the structure below;

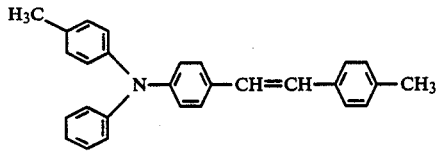

[I]

of 1 part by weight and polycarbonate resin (K-1300; made by Teijin Kasei K.K.) of 1 part by weight dissolved in dichloromethane of 10 parts by weight so that the layer thickness after drying might be 15 μm.

A charge generating layer was formed on the charge transporting layer by applying a solution for dipping so that the layer thickness might be 5μm. The solution for dipping was prepared by dispersing anthanthrone with the structure below;

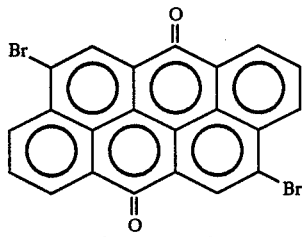

[II]

of 5 parts by weight and styryl compound of (I) of 1 part by weight and polycarbonate resin (K-1300; made by Teijin Kasei K.K.) with ball mills for 24 hours.

A resin layer was formed on the charge generating layer by applying a solution of polycarbonate (the same one as above used) of 1 part by weight dissolved in THF of 10 parts by weight so that the layer thickness after drying might be 0.2 μm.

And then an outermost surface layer of organic plasma-polymerized layer was formed with the plasma polymerization equipment shown in FIG. 3 under such conditions shown below;

Used gas

| | |
|---|---|
| hydrogen gas | 300 sccm |
| propylene gas | 10 sccm |
| perfluoropropylene | 5 sccm |
| Conditions of layer formation | |
| pressure | 0.25 Torr |
| power supply; | |
| high frequency power | |
| frequency | 13.56 MHz |
| power | 150 W |
| substrate temperature | 50° C. |
| layer formation time | 15 minutes |
| layer thickness | 2000 Å |

Evaluation

Electrostatic properties, copying resistance and electrostatic properties after the copying resistance test were evaluated for the resultant photosensitive member.

As to the electrostatic properties the photosensitive member was installed in the copying machine for electrophotography (EP-470Z made by Minolta Camera K.K.) remodeled so that the polarity of developers may be reversed, to measure the initial surface potential (Vo) when corona-charged with the power of +6.5 KV, the light exposure value $E\frac{1}{2}$(lux.sec) and the residual potential Vr(V) when irradiated with 60(lux.sec) of halogen lamp of color temperature of 2800° K.

As to the copying resistance test, image qualities were evaluated after 1, 5000, 7000, 10000, 20000, 40000, 50000, 70000, 100000 sheets of paper were developed with the EP-470Z. The ranks of image qualities were represented by the symbols "o", "Δ", "x":

"o" means that good images were formed without the lowering of image density and the generation of fogs.

"Δ" means that image density lowered or fogs generated.

"x" means that image density lowered remarkably or fogs generated remarkably.

Vo, $E\frac{1}{2}$, and Vr were measured again after the copying resistance test.

The results were shown in Table 1.

EXAMPLE 16

Copper-phthalocyanine of special α-type (made by Toyo Ink K.K.) of 25 parts by weight, thermosetting resin of acrylic melamine (a mixture of A-405 with Super Beckamine J820, made by Dainippon Ink K.K.) of 50 parts by weights, 4-diethylaminobenzaldehyde-diphenyl hydrazone of 25 parts by weight were dispersed with ball mills in organic solvent (a mixture of xylene of 7 parts by weight with butanol of 3 parts by weight) of 500 parts by weight for 10 hours.

The dispersed solution was applied by a spray method to form an organic photoconductive layer on a cylindrical aluminium substrate (60 mm in diameter×290 mm in length) so that the layer thickness might be 15 μm after baked at 150° C. for 1 hour.

And then, a thermosetting resin of acrylic melamine resin was dissolved in the same organic solvent above used and the solution was applied onto the photoconductive layer to form a resin layer so that the layer thickness might be 0.1 μm after baked at 150° C. for 15 minutes.

And then an outermost surface layer of organic plasma-polymerized layer was formed with the plasma polymerization equipment shown in FIG. 3 under such conditions shown below;

| | |
|---|---|
| Used gas | |
| hydrogen gas | 250 sccm |
| propylene gas | 60 sccm |
| perfluoropropylene | 60 sccm |
| Conditions of layer formation | |
| pressure | 0.4 Torr |
| power supply; | |
| low frequency power | |
| frequency | 60 KHz |
| power | 200 W |
| substrate temperature | 100° C. |
| layer formation time | 6 minutes |
| layer thickness | 2000 Å |

Evaluation

Electrostatic properties, copying resistance and electrostatic properties after the copying resistance test were evaluated for the resultant photosensitive member.

As to the electrostatic properties the photosensitive member was installed in the copying machine for electrophotography (EP-350Z made by Minolta Camera K.K.) remodeled so that the polarity of developers may reversed, to measure the initial surface potential (Vo) when corona-charged with the power of +6.5 KV, the light exposure value $E_{\frac{1}{2}}$(lux·sec) and the residual potential Vr(V) when irradiated with 60 (lux·sec) of halogen lamp of color temperature of 2800° K.

As to the copying resistance test, image qualities were evaluated after 1, 5000, 7000, 10000, 20000, 40000, 50000, 70000, 100000 sheets of paper were developed with the EP-470Z. The ranks of image qualities were represented by the symbols "o", "Δ", "x":

"o" means that good images were formed without the lowering of image density and the generation of fogs.

"Δ" means that image density lowered or fogs generated.

"x" means that image density lowered remarkably or fogs generated remarkably.

Vo, $E_{\frac{1}{2}}$, and Vr were measured again after the copying resistance test.

The results are shown in Table 1.

COMPARATIVE EXAMPLE 3

A photosensitive member was prepared similarly as Example 14 except that neither a resin layer nor an outermost surface layer were formed on the charge transporting layer.

The resultant photosensitive member was evaluated similarly as Example 14.

The results are shown in Table 1.

COMPARATIVE EXAMPLE 4

A photosensitive member was prepared similarly as Example 15 except that neither a resin layer nor an outermost surface layer were formed on the charge generating layer.

The resultant photosensitive member was evaluated similarly as Example 15.

The results are shown in Table 1.

COMPARATIVE EXAMPLE 5

A photosensitive member was prepared similarly as Example 16 except that neither a resin layer nor an outermost surface layer were formed on the photoconductive layer.

The resultant photosensitive member was evaluated similarly as Example 16.

The results are shown in Table 1.

COMPARATIVE EXAMPLE 6

A photosensitive member was prepared similarly as Example 14 except that a resin layer was not formed on the charge transporting layer.

The resultant photosensitive member was evaluated similarly as Example 14.

The results are shown in Table 1.

COMPARATIVE EXAMPLE 7

A photosensitive member was prepared similarly as Example 15 except that a resin layer was not formed on the charge generating layer.

The resultant photosensitive member was evaluated similarly as Example 15.

The results are shown in Table 1.

COMPARATIVE EXAMPLE 8

A photosensitive member was prepared similarly as Example 16 except that a resin layer was not formed on the photoconductive layer.

The resultant photosensitive member was evaluated similarly as Example 16.

The results are shown in Table 1.

EXAMPLE 17

Titanyl phthalocyanine (TiOPc) was vapor-deposited on a cylindrical aluminium substrate (80 mm in diameter×330 mm in length) to form a charge generating layer of 2500 Å in thickness under such conditions that the boat temperature was 400°-500° C. and the vacuum degree was $10^{-4}$-$10^{-6}$ Torr according to a resistance heat method.

A charge transporting layer was formed on the charge generating layer by applying a solution containing p-bisdiethylamino-tetraphenyl butadiene (referred to as Japanese Patent KOKAI no. 30255/1987) of 1 part by weight and polycarbonate (K-1300; made by Teijin Kasei K.K.) of 1 part by weight dissolved in tetrahydrofuran (THF) of 6 parts by weight so that the layer thickness after drying might be 15 μm.

Magnesium fluoride of 10 parts by weight and polyurethane resin (Desmojule 800, made by Nippon Poliuretan K.K.) of 15 parts by weight were dispersed in THF of 200 parts by weight with a sand-grinder and the solid content was adjusted to 5%. The dispersed solution was applied onto the charge transporting layer to form a magnesium fluoride-dispersed resin layer so that the layer thickness may be 1 μm after drying.

And then an outermost surface layer of organic plasma-polymerized layer was formed with a plasma polymerization equipment shown in FIG. 3 under such conditions shown below;

| | |
|---|---|
| Used gas | |
| hydrogen gas | 300 sccm |
| butadiene gas | 10 sccm |
| tetrafluoro carbon | 10 sccm |
| Conditions of layer formation | |
| pressure | 0.3 Torr |
| power supply; low frequency power | |
| frequency | 30 KHz |
| power | 350 W |
| substrate temperature | 70° C. |
| layer formation time | 10 minutes |
| layer thickness | 1000 Å |

Evaluation

Electrostatic properties, copying resistance and electrostatic properties after the copying resistance test were evaluated for the resultant photosensitive member.

As to the electrostatic properties the photosensitive member was installed in the copying machine for electrophotography (EP-470Z made by Minolta Camera K.K.) the light source of which was exchanged to a laser light source (780 nm of wavelength) the initial surface potential (Vo) when corona-charged with the power of −6.2 KV, the light exposure value $E_{\frac{1}{2}}$ (erg·cm$^2$)) and potential Vr(V) when irradiated with 60(lux·sec) of halogen lamp of color temperature of 2200° K.

As to the copying resistance test, image qualities were evaluated after 1, 5000, 7000, 10000, 20000, 40000, 50000, 70000, 100000 sheets of paper were developed with the EP-470Z. The ranks of image qualities were represented by the symbols "o", "Δ", "x":

"o" means that good images were formed without the lowering of image density and the generation of fogs.

"Δ" means that image density lowered or fogs generated.

"x" means that image density lowered remarkably or fogs generated remarkably.

Vo, $E\frac{1}{2}$, and Vr were measured again after the copying resistance test.

The results are shown in Table 1.

EXAMPLE 18

A charge transporting layer was formed on a cylindrical aluminium (80 mm in diameter×330 mm in length) by applying a solution of the styryl compound with the structure of (I) of 1 part by weight and polycarbonate resin (K-1300; made by Teijin Kasei K.K.) of 1 part by weight dissolved in dichloromethane of 10 parts by weight so that the layer thickness after drying may be 15 μm.

A charge generating layer was formed on the charge transporting layer by applying a solution for dipping so that the layer thickness may be 5 μm. The solution for dipping was prepared by dispersing anthanthrone with structure of (II) of 5 parts by weight and styryl compound of (I) of 1 part by weight and polycarbonate resin (K-1300; made by Teijin Kasei K.K.) with ball mills for 24 hours.

Tin oxide of 1 part by weight and polyurethane resin of 2 parts by weight were dispersed in toluene of 50 parts by weight. The dispersed solution was applied onto the charge generating layer to form a tin oxide-dispersed layer so that the layer thickness may be 2 μm after drying.

And then an outermost surface layer of organic plasma-polymerized layer was formed with the plasma polymerization equipment shown in FIG. 3 under such conditions shown below;

| | |
|---|---|
| Used gas | |
| hydrogen gas | 300 sccm |
| propylene gas | 10 sccm |
| perfluoropropylene | 5 sccm |
| Conditions of layer formation | |
| pressure | 0.25 Torr |
| power supply; | |
| high frequency power | |
| frequency | 13.56 KHz |
| power | 150 W |
| substrate temperature | 50° C. |
| layer formation time | 15 minutes |
| layer thickness | 2000 Å |

Evaluation

Electrostatic properties, copying resistance and electrostatic properties after the copying resistance test were evaluated for the resultant photosensitive member.

As to the electrostatic properties the photosensitive member was installed in the copying machine for electrophotography (EP-470Z made by Minolta Camera K.K.), remodeled so that the polarity of developers might be reversed to measure the initial surface potential (Vo) when corona-charged with the power of +6.5 KV, the light exposure value $E\frac{1}{2}$(lux·sec) and the residual potential Vr(V) when irradiated with 60 (lux·sec) of halogen lamp of color temperature of 2800° K.

As to the copying resistance test, image qualities were evaluated after 1, 5000, 7000, 10000, 20000, 40000, 50000, 70000, 100000 sheets of paper were developed with the EP-470Z. The ranks of image qualities were represented by the symbols "o", "Δ", "x":

"o" means that good images were formed without the lowering of image density and the generation of fogs.

"Δ" means that image density lowered or fogs generated.

"x" means that image density lowered remarkably or fogs generated remarkably.

Vo, $E\frac{1}{2}$, and Vr were measured again after the copying resistance test.

The results are shown in Table 1.

EXAMPLE 19

Copper-phthalocyanine of special α-type (made by Toyo Ink K.K.) of 25 parts by weight, thermosetting resin of acrylic melamine (a mixture of A-405 with Super Beckamine J820, made by Dainippon Ink K.K.) of 50 parts by weight, 4-diethylaminobenzaldehyde-diphenyl hydrazone of 25 parts by weight were dispersed with ball mills in organic solvent (a mixture of xylene of 7 parts by weight with butanol of 3 parts by weight) of 500 parts by weight for 10 hours. The dispersed solution was applied by a spray method to form an organic photoconductive layer on a cylindrical aluminium substrate (60 mm in diameter×290 mm in length) so that the layer thickness may be 15 μm after being baked at 150° C. for 1 hour.

And then, a thermosetting resin of acrylic melamine of 1 part by weight and a powder mixture of tin oxide with antimony oxide of 1 part by weight were dispersed in a mixed solution of xylene with butanol of 45 parts by weight. The solution was applied onto the photoconductive layer to form an antimony oxide-dispersed resin layer so that the layer thickness might be 1 μm after baked after being baked at 150° C. for 15 minutes.

And then an outermost surface layer of organic plasma-polymerized layer was formed with the plasma polymerization equipment shown in FIG. 3 under such conditions shown below;

| | |
|---|---|
| Used gas | |
| hydrogen gas | 250 sccm |
| butadiene gas | 60 sccm |
| tetrafluoro carbon | 60 sccm |
| Conditions of layer formation | |
| pressure | 0.4 Torr |
| power supply; | |
| low frequency power | |
| frequency | 60 KHz |
| power | 200 W |
| substrate temperature | 100° C. |
| layer formation time | 6 minutes |
| layer thickness | 2000 Å |

Evaluation

Electrostatic properties, copying resistance and electrostatic properties after the copying resistance test were evaluated for the resultant photosensitive member.

As to the electrostatic properties the photosensitive member was installed in the copying machine for electrophotography (EP-350Z made by Minolta Camera K.K.), to measure the initial surface potential (Vo)

when corona-charged with the power of +6.5 KV, the light exposure value $E\frac{1}{2}$(lux·sec) and the residual potential Vr(V) when irradiated with 60 (lux·sec) of a halogen lamp of a color temperature of 2800° K.

As to the copying resistance test, image qualities were evaluated after 1, 5000, 7000, 10000, 20000, 40000, 50000, 70000, 100000 sheets of paper were developed with the EP-350Z. The ranks of image qualities were represented by the symbols "o", "Δ", "x":

"o" means that good images were formed without the lowering of image density and the generation of fogs.

"Δ" means that image density lowered or fogs generated.

"x" means that image density lowered remarkably or fogs generated remarkably.

Vo, $E\frac{1}{2}$, and Vr were measured again after the copying resistance test.

The results are shown in Table 1. Table 1

TABLE 1

| | electrostatic properties | | |
|---|---|---|---|
| | Vo (V) | $E\frac{1}{2}$ (erg/cm$^2$) | Vr (V) |
| Example 14 | −600 | 4.9 | −10 |
| Comparative Example 3 | −600 | 4.9 | −5 |
| Comparative Example 6 | −600 | 15.3 | −62 |
| Example 17 | −600 | 4.8 | −5 |
| Example 15 | +600 | 3.1 | +20 |
| Comparative Example 4 | +600 | 3.1 | +15 |
| | Vo (V) | $E\frac{1}{2}$ (lux.sec) | Vr (V) |
| Comparative Example 7 | +600 | 80 | +550 |
| Example 16 | +600 | 4.3 | +10 |
| Example 18 | +600 | 3.0 | +15 |
| Example 19 | +600 | 4.3 | +5 |
| Comparative Example 5 | +600 | 4.3 | +5 |
| Comparative Example 8 | +600 | 7.8 | −57 |

| | copying resistance test | | | | |
|---|---|---|---|---|---|
| | initial | 5K | 7K | 10K | 20K |
| Example 14 | o | o | o | o | o |
| Comparative Example 3 | o | o | o | o | Δ |
| Comparative Example 6 | copying resistant test was not carried out because the sensitivity was bad | | | | |
| Example 17 | o | o | o | o | o |
| Example 15 | o | o | o | o | o |
| Comparative Example 4 | o | Δ | x | stopped the copying test at 7K | |
| Comparative Example 7 | copying resistant test was not carried out because the sensitivity was not obtained | | | | |
| Example 16 | o | o | o | o | o |
| Example 18 | o | o | o | o | o |
| Example 19 | o | o | o | o | o |
| Comparative Example 5 | o | o | o | o | o |
| Comparative Example 8 | copying resistant test was not carried out because the sensitivity was bad | | | | |

| | copying resistance test | | | |
|---|---|---|---|---|
| | 40K | 50K | 70K | 100K |
| Example 14 | o | o | o | o |
| Comparative Example 3 | Δ | x | stopped at 50k | |
| Comparative Example 6 | copying resistant test was not carried out because the sensitivity was bad | | | |
| Example 17 | o | o | o | o |
| Example 15 | o | o | o | o |
| Comparative Example 4 | stopped the copying test at 7K | | | |
| Example 16 | o | o | o | o |
| Example 18 | o | o | o | o |
| Example 19 | o | o | o | o |
| Comparative Example 5 | o | o | o | *1 |
| Comparative Example 8 | copying resistant test was not carried out because the sensitivity was bad | | | |

TABLE 1-continued

| | electrostatic properties after copying resistance test | | |
|---|---|---|---|
| | Vo (V) | $E\frac{1}{2}$ (erg/cm$^2$) | Vr (V) |
| Example 14 | −600 | 5.0 | −10 |
| Comparative Example 3 | −230 | 5.3 | −3 |
| Comparative Example 6 | — | — | — |
| Example 17 | −600 | 4.8 | −5 |
| Example 15 | +600 | 3.1 | +20 |
| Comparative Example 4 | +280 | 4.8 | +12 |
| Comparative Example 7 | — | — | — |
| Example 16 | +600 | 4.4 | +10 |
| Example 18 | +600 | 3.0 | +15 |
| Example 19 | +600 | 4.4 | +5 |
| Comparative Example 5 | +270 | 5.7 | +4 |
| Comparative Example 8 | — | — | — |

*1 stopped the copying at 70K

EXAMPLE 20

Se-Te alloy was a vapor-deposited in a vacuum at the degree of $10^{-5}$ Torr by a heat resistance method to form a Se-Te photoconductive layer of about 60 μm in thickness on an aluminium substrate (80 mm in diameter×330 mm in length).

Magnesium fluoride of 10 parts by weight and polyurethane resin (Desmojule 800, made by Nippon Poliuretan K.K.) of 15 parts by weight were dispersed in THF of 200 parts by weight with a sand-grinder and the solid content was adjusted to 5%. The dispersed solution was applied onto the photoconductive layer to form a magnesium fluoride-dispersed resin layer so that the layer thickness may be 1 μm after drying.

And then an outermost surface layer of organic plasma-polymerized layer was formed with a plasma polymerization equipment shown in FIG. 3 under such conditions shown below;

| | |
|---|---|
| Used gas | |
| hydrogen gas | 300 sccm |
| butadiene gas | 10 sccm |
| tetrafluoro carbon | 10 sccm |
| Conditions of layer formation | |
| pressure | 0.3 Torr |
| power supply; low frequency power | |
| frequency | 30 KHz |
| power | 350 W |
| substrate temperature | 70° C. |
| layer formation time | 10 minutes |
| layer thickness | 1000 Å |

Evaluation of the photosensitive member

The pencil hardness of the surface of the resultant photosensitive member was measured according to JIS-K-5400 to obtain about 6H. It was understood that the photosensitive member was hardened by the formation of the surface protective layer.

The adhesion properties were also evaluated by a cross-cut adhesion test according to JIS-K-5400 to get 10 points. It was understood that the surface protective layer of the photosensitive member of the invention was excellent in adhesivity.

The resultant photosensitive member was charged to the potential of +600 V with 6.7 KV power of a charger according to the usual Carlson process, and the sensitivity to white light was measured to get about 1.7 lux·sec of $E_{\frac{1}{2}}$. It was confirmed that a surface protective layer of the photosensitive member of the invention did not deteriorate the original sensitivity of a photosensitive of member of a monolayer type made of selenium-tellurium alloy, which showed sensitivity ($E_{\frac{1}{2}}$) of about 1.8 lux·sec before the formation of the surface protective layer.

The photosensitive member was left under an environment for 6 hours such that the low temperature and low humidity atmosphere of 10° C. of temperature and 30% of relative humidity, and the high temperature and high humidity atmosphere of 50° C. of temperature and 90% of relative humidity were repeated by alternating turns at 30 minutes intervals. The peeling off or the cracking of the surface protective layer was not observed and it was understood that the surface protective layer of the invention was excellent in practical adhesivity with the photoconductive layer of a monolayer type made of selenium-tellurium alloy.

The obtained photosensitive member was installed in the copying machine EP 650Z made by Camera K.K. to evaluate copying resistance when provided to the developing process under conditions of 35° C. of temperature and 80% of relative humidity. The contact of the photosensitive member with developers, sheets of copying paper and cleaning members in the copying machine did not cause the peeling off of the surface protective layer.

Even after 250000 sheets of paper were developed with the copying machine in usual circumstances clear images were always formed.

Further, selenium or tellurium etc. were not detected by the surface composition analysis according to Auger analysis after the practical development of 250000 sheets of paper.

Accordingly, it was confirmed that the surface protective layer of the invention could achieve the improvement of the durability and the decrease of poisonous harm without the deterioration of image quality.

EXAMPLE 21

$As_2Se_3$ alloy was vapor-deposited in a vacuum at the degree of $10^{-6}$ Torr by a heat resistance method to form an $As_2Se_3$ photoconductive layer of about 50 μm in thickness on an aluminium substrate (80 mm in diameter×330 mm in length).

Tin oxide of 1 part by weight and polyurethane resin of 2 parts by weight were dispersed in toluene of 50 parts by weight. The dispersed solution was applied onto the photoconductive layer to form a tin oxide-dispersed resin layer so that the layer thickness might be 1 μm after drying.

And then an outermost surface layer of organic plasma-polymerized layer was formed with a plasma polymerization equipment shown in FIG. 3 under such conditions shown below;

| | | |
|---|---|---|
| Used gas | | |
| hydrogen gas | 300 | sccm |
| propylene gas | 10 | sccm |
| perfluoropropylene | 5 | sccm |
| Conditions of layer formation | | |
| pressure | 0.25 | Torr |
| power supply; | | |
| high frequency power | | |
| frequency | 13.56 | MHz |
| power | 150 | W |
| substrate temperature | 50° | C. |
| layer formation time | 15 | minutes |
| layer thickness | 2000 | Å |

Properties

The resultant photosensitive member had similar properties as those of the photosensitive member of Example 20. Further selenium, arsenic and so on not detected from a cleaning blade used during the copying resistance test or from wasted toners.

Accordingly, it was confirmed that a surface protective layer of the invention could achieve the improvement of the durability and the decrease of poisonous harm without the deterioration of image quality.

EXAMPLE 22

A photosensitive member was prepared similarly as Example 20 except that a tin oxide-dispersed resin layer was formed by a dipping method with a solution for dispersion so that the layer thickness after drying might be about 0.2 μm. The solution for dispersion was prepared by adding acrylic polyol(Acrydick A808: by Dainippon Ink K.K.) of 2.0 part by weight, isocyanate compound (Barnock DN950; made by Dainippon Isocyanate K.K.) of 1.9 part by weight and tin oxide of 0.8 part by weight to a mixed solvent of methyl ethyl ketone of 76.1 parts by weight with Isopar H (Esso chemical Co.,) of 20 parts by weight and then being stirred for 1 hour.

Properties

The resultant photosensitive member had similar properties as those of the photosensitive member of Example 20. Further selenium, tellurium and so on were not detected from a cleaning blade used during the copying resistance test or from wasted toners.

Accordingly, it was confirmed that a surface protective layer of the invention could achieve the improvement of the durability and the decrease of poisonous harm without the deterioration of image quality.

EXAMPLE 23

Se-Te-As alloy was vapor-deposited in vacuum at the degree of $10^{-6}$ Torr by a heat resistance method to form a Se-Te-As photoconductive layer of about 40 μm in thickness on an aluminium substrate (80 mm in diameter×300 mm in length).

And then a thermosetting resin of acrylic melamine of 1 part by weight and a powder mixture of 1 part by weight of tin oxide with antimony oxide were dispersed in a mixed solution of xylene with butanol of 45 parts by weight. The solution was applied onto the photoconductive layer to form a tin oxide and antimony oxide-dispersed resin layer so that the layer thickness might be 1 μm after baking at 80° C. for 15 minutes.

And then, an outermost surface layer of organic plasma-polymerized layer was formed with the plasma polymerization equipment shown in FIG. 3 under such conditions shown below;

| | |
|---|---|
| Used gas | |
| hydrogen gas | 250 sccm |
| butadiene gas | 60 sccm |
| tetrafluoro carbon | 60 sccm |
| Conditions of layer formation | |
| pressure | 0.4 Torr |
| power supply; | |
| low frequency power | |
| frequency | 60 KHz |
| power | 200 W |
| substrate temperature | 100° C. |
| layer formation time | 6 minutes |
| layer thickness | 2000 Å |

Properties

The resultant photosensitive member had similar properties as those of the photosensitive member of Example 20. Further selenium, tellurium, arsenic and so on were not detected from a cleaning blade used during the copying resistance test nor from wasted toners.

Accordingly, it was confirmed that a surface protective layer of the invention could achieve the improvement of the durability and the decrease of poisonous harm without the deterioration of image quality.

EXAMPLE 24

A photosensitive member was prepared similarly as example 20 except that phosphine gas diluted to 10% with hydrogen gas was further fed at the flow rate of 100 sccm.

The resultant a - C layer was analyzed by organic quantitative analysis and Auger analysis to find hydrogen contained at 42 atm. % and phosphorus at a maximum of 1.0 atm. % along with the depth of the layer on the basis of all atoms constituting the a - C layer.

The charger needed the power of +5.2 kV in order to charge the resultant photosensitive member to the level of +600 V according to the usual Carlson process.

Therefore, it was understood that the chargeability was improved because the addition of an atom of Group V in the periodic table or phosphorus enabled the charging to the level +600 V with less power. Other properties are the same as those of Example 20.

EXAMPLE 25

A tin oxide and antimony oxide dispersed resin layer was formed on a photoconductive layer of a monolayer type of selenium-arsenic alloy over an electrically conductive and cylindrical aluminium substrate (80 mm in diameter×330 mm in length) by spray-coating of a solution containing 3.5 parts by weight of epoxy resin (Epiculone 1050: made by Dainippon Ink K.K.), 1.0 part by weight of a mixed power of tin oxide with antimony oxide and 96.5 parts by weight of toluene so that the layer thickness might be about 0.2 μm after drying at 80° C. of temperature for 1 hour. The selenium-arsenic layer was formed with a vapor-depositing equipment to be 50 μm in thickness according to a usual method.

Then, an outermost surface layer of a - C layer was formed on the resultant tin oxide and antimony oxide dispersed resin layer with the glow-discharge decomposition equipment shown in FIG. 3.

First the reaction chamber (733) was evacuated inside to a high level of approximately $10^6$ Torr, and then by opening No. 1, No. 2 and No. 3 regulating valves (707) (708) and (709), hydrogen gas from No. 1 tank (701), butadiene gas from No. 2 tank (702) and tetrafluorocarbon gas from No. 3 tank (703) were fed, under output pressure gauge reading of 1 Kg/cm$^2$, into mass flow controllers (713), (714) and (715). Then, the mass flow controllers were set so as to make hydrogen flow at 100 sccm, butadiene flow at 60 sccm, and tetrafluorocarbon flow at 120 sccm and the gases were allowed into the reaction chamber (733) from the main pipe (732) through the mixer (731). After the respective flows had stabilized, the internal pressure of the reaction chamber (733) was adjusted to 0.5 Torr. On the other hand, the electrically conductive and cylindrical aluminium substrate (752) with a monolayer of selenium-arsenic alloy on which the tin oxide and antimony oxide dispersed resin layer was formed was preliminarily heated up to 50° C. for about 15 minutes before the gas introduction.

While the gas flows and the internal pressure were stabilized, it was connected to the low frequency power source (741) and 150 watts power (frequency; 100 KHz) was applied to the power-applying electrode (736). After plasma polymerization for approximately about 1 minute, there was formed an outermost surface layer of an a - C layer with a thickness of approximately 0.10 μm over the substrate (752).

After the layer formation, the electric power supply was stopped. The regulating valves except for hydrogen gas were closed. Hydrogen gas was only introduced to the reaction chamber (733) at the flow rate of 20 sccm so that the pressure inside might be maintained at 10 Torr.

After the temperature inside the chamber was decreased to 30° C. for about 15 minutes, the regulating valve for hydrogen gas was closed for the reaction chamber (733) to be evacuated inside, and then the vacuum of the reaction chamber (733) was released to take out a photosensitive member with the surface protective layer of the invention.

The resultant a - C layer was analyzed by organic analysis and Auger analysis to find hydrogen contained at 40 atm. % and fluorine at 3.7 atm. % on the basis of all atoms constituting the a - C layer.

Evaluation of the photosensitive member

The pencil hardness of the surface of the resultant photosensitive member was measured according to JIS-K-5400 to obtain about 6H. It was understood that the photosensitive member was hardened by the formation of the surface protective layer.

The adhesion properties were also evaluated by cross-cut adhesion test according to JIS-K-5400 test to get 10 points. It was understood that the surface protective member of the invention was excellent in adhesivity.

The resultant photosensitive member was charged to the potential of +600 V with 6.8 kV power of a charger according to the usual Carlson process, and the sensitivity to white light was measured to get about 0.86 lux·sec of $E_{\frac{1}{2}}$.

It was confirmed that a surface protective layer of the photosensitive member of the invention did not deteriorate the original sensitivity of a photosensitive member of a monolayer type made of selenium-arsenic alloy, which showed sensitivity of about 0.90 lux·sec before the formation of the surface protective layer.

The photosensitive member was left under an environment for 6 hours such that the low temperature and low humidity atmosphere of 10° C. temperature and 30% of relative humidity, and the high temperature and high humidity atmosphere of 50° C. of temperature and 90% of relative humidity were repeated by alternating turns at 30 minute intervals.

The peeling off or the cracking of the surface protective layer was not observed and it was understood that the surface protective layer of the invention was excellent in practical adhesivity with the photoconductive layer of monolayer type made of selenium-arsenic alloy.

The obtained photosensitive member was installed in the copying machine EP 650Z made by Minolta Camera K.K. to evaluate copying resistance when provided to the developing process. It gave clear copy image in that image flows were not observed when it was used in the developing process under conditions of 35° C. of temperature and 80% of relative humidity. The contact of the photosensitive member with developers, sheets of copying paper and cleaning members in the copying machine did not cause the peeling off of the surface protective layer.

Even after 250000 sheets of paper were developed with the copying machine in usual circumstances, clear images were always formed. Further, selenium or arsenic etc. is not detected by the surface composition analysis according to Auger analysis after the practical development of 250000 sheets of paper.

Filming phenomena were not observed on the surface of the photosensitive member and the slip characteristics of the surface was good.

Accordingly, it was confirmed that a surface protective layer of the invention could achieve the improvement of the durability and the decease of poisonous harm without the deterioration of image quality.

What is claimed is:

1. A photosensitive member of a laminated type comprising a surface protective layer on a photoconductive layer formed over an electrically conductive substrate, wherein the surface protective layer comprises first and second layers, said first layer comprising resin as a main constituent and being from 0.05 to 5 μm in thickness, said second layer as an outermost surface layer comprising an amorphous hydrocarbon layer and being from 0.01 to 5 μm in thickness.

2. A photosensitive member of the claim 1, wherein the second layer of the amorphous hydrocarbon layer contains hydrogen at the content of from 5 to 60 atomic % on the basis of the total number of atoms constituting the amorphous hydrocarbon layer.

3. A photosensitive member of the claim 1, wherein the second layer of the amorphous hydrocarbon layer contains halogen.

4. A photosensitive member of the claim 1, wherein the second layer of the amorphous hydrocarbon layer contains at least one of oxygen and nitrogen.

5. A photosensitive member of the claim 1, wherein the second layer of the amorphous hydrocarbon layer contains an element of Group III of the Periodic Table.

6. A photosensitive member of the claim 1, wherein the second layer of the amorphous hydrocarbon layer contains an element of Group V of the Periodic Table.

7. A photosensitive member of a laminated type comprising a surface protective layer on a photoconductive layer formed over an electrically conductive substrate, where in the photoconductive layer is a selenium Compound, and the surface protective layer comprises first and second layers, said first layer comprising resin as a main constituent and being from 0.05 to 5 μm in thickness said second layer as an outermost surface layer comprising an amorphous hydrocarbon layer and being from 0.01 to 5 μm in thickness.

8. A photosensitive member of the claim 7, wherein the second layer of the amorphous hydrocarbon layer contains hydrogen at the content of from 5 to 60 atomic % on the basis of the total number of atoms constituting the amorphous hydrocarbon layer.

9. A photosensitive member of the claim 7, wherein the photoconductive layer is a monolayer type of a selenium-arsenic alloy.

10. A photosensitive member of the claim 7, wherein the photoconductive layer is a laminated type of a selenium-tellurium alloy which is formed on selenium.

11. A photosensitive member of a laminated type comprising a surface protective layer on a photoconductive layer formed over an electrically conductive substrate, wherein the photoconductive layer is a selenium compound, and the surface protective layer comprises first and second layers, said first layer comprising a metal compound with low electrical resistance dispersed in resin and being from 0.05 to 5 μm in thickness, said second layer as an outermost surface layer comprising an amorphous hydrocarbon layer and being from 0.01 to 5 μm in thickness.

12. A photosensitive member of the claim 11 wherein the first layer has an electrical resistance of from $10^9$ to $10^{14}$ ohm.cm.

13. A photosensitive member of the claim 11 wherein the metal compound with low electrical resistance has an electrical resistance of $10^9$ ohm.cm or less.

14. A photosensitive member of the claim 11 wherein the second layer of the amorphous hydrocarbon layer contains hydrogen at the content of from 5 to 60 atomic % on the basis of the total number of atoms constituting the amorphous hydrocarbon layer.

15. A photosensitive member of the claim 11, wherein the metal compound with low electrical resistance is 0.3 μm or less in particle size.

16. A photosensitive member of the claim 11, wherein the photoconductive layer is a monolayer type of a selenium-arsenic alloy.

17. A photosensitive member of the claim 11, wherein the photoconductive layer is a laminated type of a selenium-tellurium alloy with is formed on selenium.

18. A photosensitive member of a laminated type comprising a surface protective layer on a photoconductive layer formed over an electrically conductive substrate, wherein the photoconductive layer is an organic photoconductive layer, and the surface protective layer comprises first and second layers, said first layer comprising resin as a main constituent and being from 0.05 to 5 μm in thickness, said second layer as an outermost surface layer comprising an amorphous hydrocarbon layer and being from 0.01 to 5 μm in thickness.

19. A photosensitive member of the claim 18, wherein the second layer of the amorphous hydrocarbon layer contains hydrogen at the content of from 5 to 60 atomic % on the basis of the total number of atoms constituting the amorphous hydrocarbon layer.

20. A photosensitive member of the claim 18, wherein the organic photoconductive layer comprises a charge transporting layer on a charge generating layer.

21. A photosensitive member of the claim 18, wherein the organic photoconductive layer comprises a charge generating layer on a charge transporting layer.

22. A photosensitive member of the claim 18, wherein the organic photoconductive layer is a monolayer type comprising a dispersed material in a binder resin.

23. A photosensitive member of a laminated type comprising a surface protective layer on a photoconductive layer formed over an electrically conductive substrate, wherein the photoconductive layer is an organic photoconductive layer, and the surface protective layer comprises first and second layers, said first layer comprising a metal compound with low electrical resistance dispersed in resin and being from 0.05 to 5 μm in thickness, said second layer as an outermost surface layer comprising an amorphous hydrocarbon layer and being from 0.01 to 5 μm in thickness.

24. A photosensitive member of the claim 23, wherein the first layer has an electrical resistance of from $10^9$ to $10^{14}$ ohm.cm.

25. A photosensitive member of the claim 23, wherein the metal compound with low electrical resistance has an electrical resistance of $10^9$ ohm.cm. or less.

26. A photosensitive member of the claim 23, wherein the second layer of the amorphous hydrocarbon layer contains hydrogen at the content of from 5 to 60% atomic on the basis of the total number of atoms constituting the amorphous hydrocarbon layer.

27. A photosensitive member of the claim 23, wherein the metal compound with low electrical resistance is 0.3 μm or less in particle size.

28. A photosensitive member of the claim 23, wherein the organic photoconductive layer comprises a charge transporting layer on a charge generating layer.

29. A photosensitive member of the claim 23, wherein the organic photoconductive layer comprises a charge generating layer on a charge transporting layer.

30. A photosensitive member of the claim 23, wherein the organic photoconductive layer is a monolayer type comprising a dispersed charge generating material and a dispersed charge transporting material in a binder resin.

* * * * *